US008035595B2

(12) United States Patent
Tomita

(10) Patent No.: US 8,035,595 B2
(45) Date of Patent: Oct. 11, 2011

(54) LIQUID CRYSTAL PANEL, DRIVING METHOD FOR LIQUID CRYSTAL PANEL, AND PROGRAM

(75) Inventor: Hideo Tomita, Kanagawa (JP)

(73) Assignee: Sony Corporation (JP)

( * ) Notice: Subject to any disclaimer, the term of this patent is extended or adjusted under 35 U.S.C. 154(b) by 1210 days.

(21) Appl. No.: 11/787,564

(22) Filed: Apr. 16, 2007

(65) Prior Publication Data

US 2007/0242012 A1 Oct. 18, 2007

(30) Foreign Application Priority Data

Apr. 18, 2006 (JP) ..... P2006-114047

(51) Int. Cl.
*G09G 3/36* (2006.01)

(52) U.S. Cl. ..... 345/90; 345/87; 345/98; 345/100

(58) Field of Classification Search ..... 345/84, 345/87, 88, 90, 98, 100, 204, 205, 206
See application file for complete search history.

(56) References Cited

U.S. PATENT DOCUMENTS

| | | | | |
|---|---|---|---|---|
| 6,756,953 | B1 * | 6/2004 | Tokioka et al. | 345/87 |
| 6,876,339 | B2 | 4/2005 | Hiroki | |
| 7,215,308 | B2 * | 5/2007 | Orii et al. | 345/87 |

FOREIGN PATENT DOCUMENTS

| | | | |
|---|---|---|---|
| CN | 1308311 | A | 8/2001 |
| JP | 7-146666 | A | 6/1995 |
| JP | 9-325715 | A | 12/1997 |
| JP | 11-331879 | A | 11/1999 |
| JP | 2000-181394 | A | 6/2000 |
| JP | 2004-029220 | A | 1/2004 |

* cited by examiner

*Primary Examiner* — My-Chau T Tran
(74) *Attorney, Agent, or Firm* — Lerner, David, Littenberg, Krumholz & Mentlik, LLP

(57) ABSTRACT

Herein disclosed a liquid crystal panel, including: a plurality of liquid crystal cells each serving as a pixel and disposed in a matrix of N horizontal lines and M vertical lines, each of N and M being an integral value equal to or greater than 1; a switching element provided for each of said pixels and configured to provide a driving voltage to the pixel; the M switching elements which are included in one vertical line having a common source line; and a vertical activation section configured to render gate lines of α ones of the M switching elements included in one vertical line active simultaneously, α being an integral value equal to or greater than 1 but equal to or smaller than M.

6 Claims, 17 Drawing Sheets

LIQUID CRYSTAL PANEL, DRIVING METHOD FOR LIQUID CRYSTAL PANEL, AND PROGRAM

CROSS REFERENCES TO RELATED APPLICATIONS

The present invention contains subject matter related to Japanese Patent Application JP 2006-114047 filed with the Japan Patent Office on Apr. 18, 2006, the entire contents of which being incorporated herein by reference.

BACKGROUND OF THE INVENTION

1. Field of the Invention

This invention relates to a liquid crystal panel, a driving method for a liquid crystal panel, and a program.

2. Description of the Related Art

In recent years, the improvement in resolution of a liquid crystal panel (for example, refer to Japanese Patent Laid-Open No. 2004-029220) has proceeded to such a degree that a liquid crystal panel which is ready for an image signal having a resolution of approximately 2,048×1,080 pixels is popularized. The image signal is a high-definition signal and is hereinafter referred to as 2K signal. Further, in order to make it possible to utilize a liquid crystal panel in the field of digital cinemas and so forth, also a liquid crystal panel has been developed which is ready for an image signal of a resolution of approximately 4,096×2,160 pixels. The video signal mentioned has a resolution equal to approximately four times that of the 2K signal and is hereinafter referred to as 4K signal.

SUMMARY OF THE INVENTION

However, a liquid crystal panel which is ready for the 4K signal is just designed for exclusive use for the 4K signal while another liquid crystal panel which is ready for the 2K signal is just designed for exclusive use for the 2K signal. In other words, in the present situation, it is obliged to develop and manufacture a liquid crystal panel for the 2K signal and a liquid crystal panel for the 4K signal independently and separately from each other. However, this is not preferable in terms of the cost and so forth. Therefore, it is demanded to implement a liquid crystal panel which is ready for both of the 2K signal and the 4K signal, that is, to implement common application of a liquid crystal panel to the 2K signal and the 4K signal.

While the 2K signal and the 4K signal are mere examples and a liquid crystal panel which can be applied to a plurality of signals of different resolutions including additional resolutions is demanded, such a liquid crystal panel as just described has not been implemented as yet.

Therefore, it is demanded to provide a liquid crystal panel which can be applied to a plurality of signals of different resolutions.

According to an embodiment of the present invention, there is provided a liquid crystal panel including a plurality of liquid crystal cells each serving as a pixel and disposed in a matrix of N horizontal lines and M vertical lines, each of N and M being an integral value equal to or greater than 1, a switching element provided for each of the pixels and configured to provide a driving voltage to the pixel, the M switching elements which are included in one vertical line having a common source line, and a vertical activation section configured to render gate lines of $\alpha$ ones of the M switching elements included in one vertical line active simultaneously, $\alpha$ being an integral value equal to or greater than 1 but equal to or smaller than M.

The liquid crystal panel may further include a horizontal activation section configured to render the source line common to the M pixels on one vertical line active simultaneously across $\beta$ ones of the vertical lines, $\beta$ being an integral value equal to or greater than 1 but equal to or smaller than N.

According to another embodiment, there is provided a driving method for a liquid crystal panel which includes a plurality of liquid crystal cells each serving as a pixel and disposed in a matrix of N horizontal lines and M vertical lines, each of N and M being an integral value equal to or greater than 1, and a switching element provided for each of the pixels and configured to provide a driving voltage to the pixel, including, the M switching elements which are included in one vertical line having a common source line, a step of rendering gate lines of $\alpha$ ones of the M switching elements included in one vertical line active simultaneously, $\alpha$ being an integral value equal to or greater than 1 but equal to or smaller than M. Also a program for carrying out the method is provided.

In the liquid crystal panel, driving method for a liquid crystal panel and program, the present invention is applied to a liquid crystal panel which includes a plurality of liquid crystal cells each serving as a pixel and disposed in a matrix of N horizontal lines and M vertical lines, each of N and M being an integral value equal to or greater than 1, and a switching element provided for each of the pixels and configured to provide a driving voltage to the pixel, the M switching elements which are included in one vertical line having a common source line. In the liquid crystal panel, the gate lines of $\alpha$ ones of the M switching elements included in one vertical line are rendered active simultaneously. Here, $\alpha$ is an integral value equal to or greater than 1 but equal to or smaller than M.

As occasion demands, the source line common to the M pixels on one vertical line is rendered active simultaneously across $\beta$ ones of the vertical lines. Here, $\beta$ is an integral value equal to or greater than 1 but equal to or smaller than N.

According to a further embodiment of the present invention, there is provided a liquid crystal panel including a plurality of liquid crystal cells each serving as a pixel and disposed in a matrix of N horizontal lines and M vertical lines, each of N and M being an integral value equal to or greater than 1, a switching element provided for each of the pixels and configured to provide a driving voltage to the pixel, the M switching elements which are included in one vertical line having a common source line, and a horizontal activation section configured to render the source line common to the M pixels on one vertical line active simultaneously across $\beta$ ones of the vertical lines, $\beta$ being an integral value equal to or greater than 1 but equal to or smaller than N.

According to a still further embodiment of the present invention, there is provided a driving method for a liquid crystal panel which includes a plurality of liquid crystal cells each serving as a pixel and disposed in a matrix of N horizontal lines and M vertical lines, each of N and M being an integral value equal to or greater than 1, and a switching element provided for each of the pixels and configured to provide a driving voltage to the pixel, including, the M switching elements which are included in one vertical line having a common source line, a step of rendering the source line common to the M pixels on one vertical line active simultaneously across $\beta$ ones of the vertical lines, $\beta$ being an integral value equal to or greater than 1 but equal to or smaller than N. Also a program for carrying out the method is provided.

Also in the liquid crystal panel, driving method for a liquid crystal panel and program, the present invention is applied to a liquid crystal panel which includes a plurality of liquid crystal cells each serving as a pixel and disposed in a matrix of N horizontal lines and M vertical lines, each of N and M being an integral value equal to or greater than 1, and a switching element provided for each of the pixels and configured to provide a driving voltage to the pixel, the M switching elements which are included in one vertical line having a common source line. In the liquid crystal panel, the source line common to the M pixels on one vertical line is rendered active simultaneously across β ones of the vertical lines. Here, β is an integral value equal to or greater than 1 but equal to or smaller than N.

In summary, according to the present invention, a liquid crystal panel can be provided which can be applied commonly to a plurality of signals of different resolutions.

The above and other features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Before a preferred embodiment of the present invention is described in detail, a corresponding relationship between several features recited in the accompanying claims and particular elements of the preferred embodiment described below is described. The description, however, is merely for the confirmation that the particular elements which support the invention as recited in the claims are disclosed in the description of the embodiment of the present invention. Accordingly, even if some particular element which is recited in description of the embodiment is not recited as one of the features in the following description, this does not signify that the particular element does not correspond to the feature. On the contrary, even if some particular element is recited as an element corresponding to one of the features, this does not signify that the element does not correspond to any other feature than the element.

Further, the following description does not signify that the prevent invention corresponding to particular elements described in the embodiment of the present invention is all described in the claims. In other words, the following description does not deny the presence of an invention which corresponds to a particular element described in the description of the embodiment of the present invention but is not recited in the claims, that is, the description does not deny the presence of an invention which may be filed for patent in a divisional patent application or may be additionally included into the present patent application as a result of later amendment to the claims.

Figure 8:
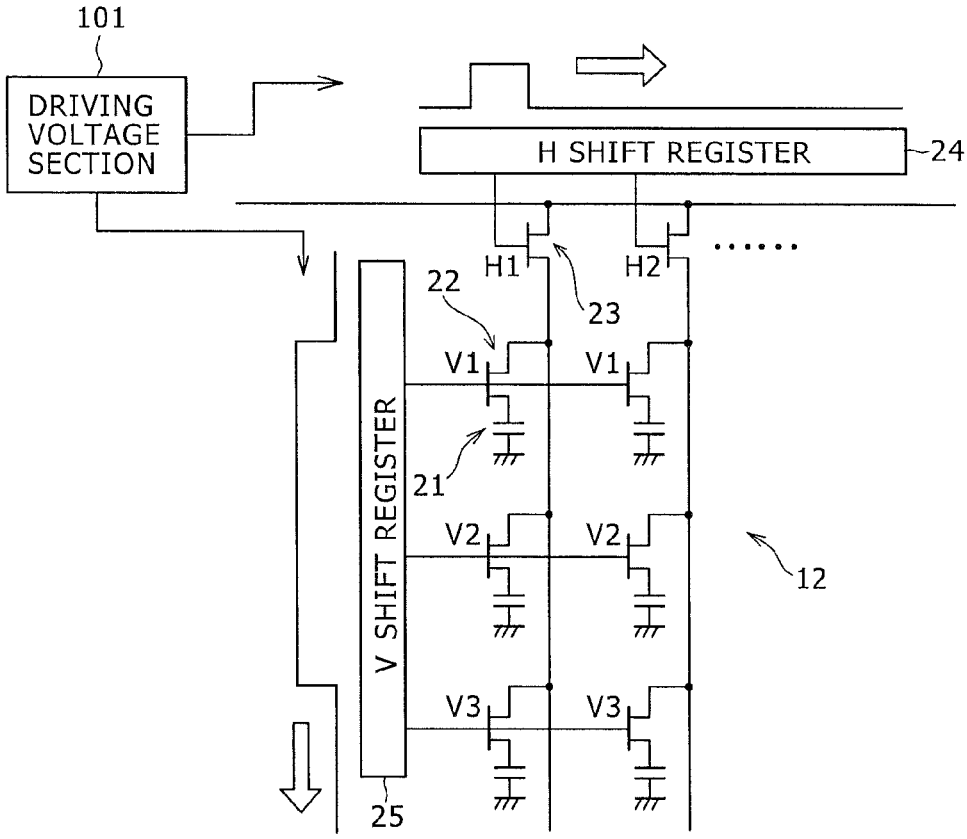
FIG. 8 is a diagrammatic view illustrating a vertical pixel simultaneous writing method to which the present invention is applied.
Figure 11:
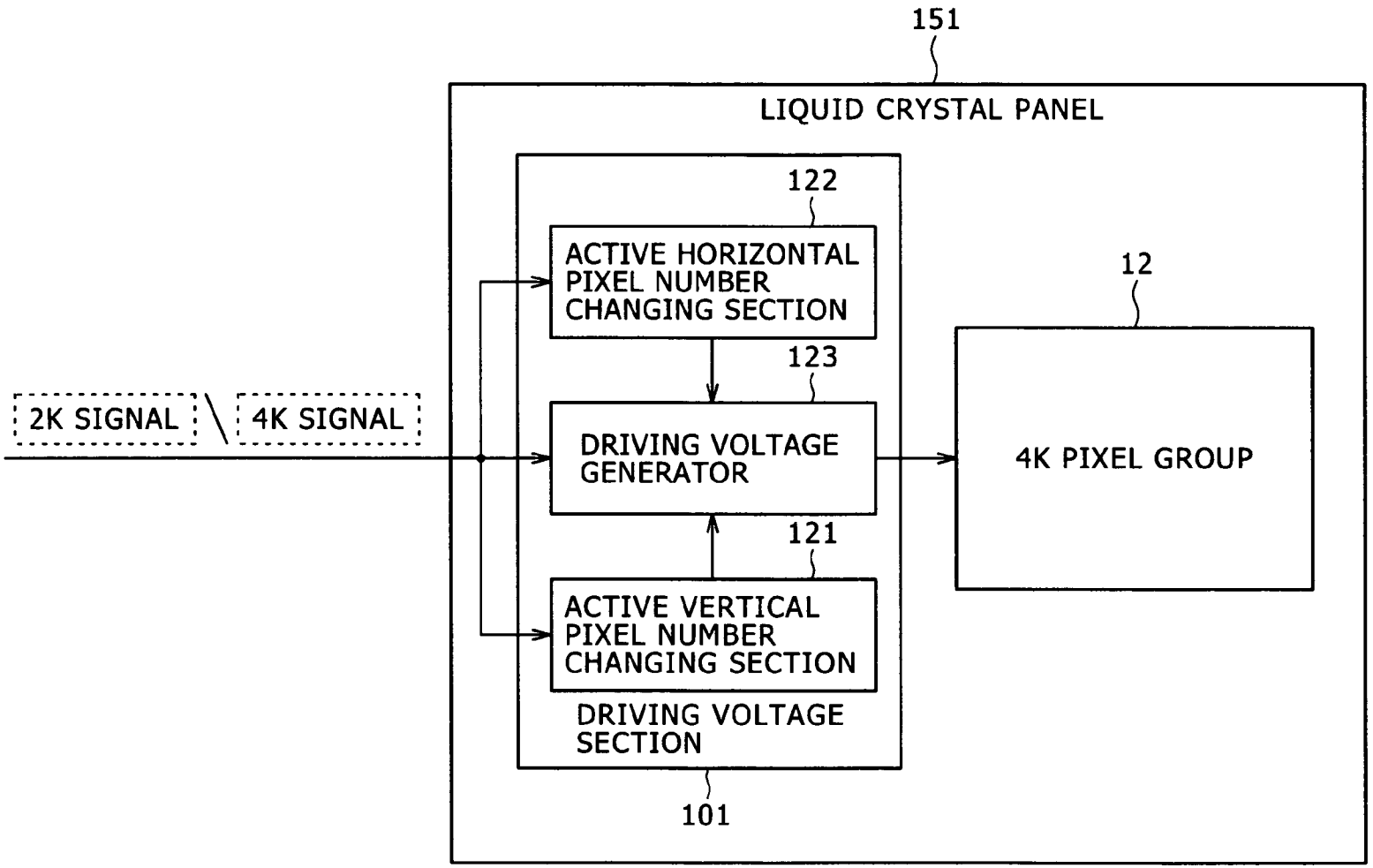
FIG. 11 is a block diagram showing an example of a configuration of a liquid crystal panel which can carry out the operation of FIGS. 8 to 10, that is, to which the present invention is applied.

According to an embodiment of the present invention, there is provided a liquid crystal panel (for example, a liquid crystal panel 151 of FIG. 11) including a plurality of liquid crystal cells each serving as a pixel (for example, a pixel 21 of FIG. 8) and disposed in a matrix of N horizontal lines and M vertical lines, each of N and M being an integral value equal to or greater than 1, a switching element (for example, a switching element 22 of FIG. 8) provided for each of the pixels and configured to provide a driving voltage to the pixel, the M switching elements which are included in one vertical line having a common source line (for example, common through a switching element 23 of FIG. 8), and a vertical activation section (for example, particularly an active vertical pixel number changing section 121 of FIG. 11 in a driving voltage section 101 which applies a pulse voltage to a V shift register 25 as seen in FIG. 8) configured to render gate lines of α ones of the M switching elements included in one vertical line active simultaneously, a being an integral value equal to or greater than 1 but equal to or smaller than M.

Figure 10:
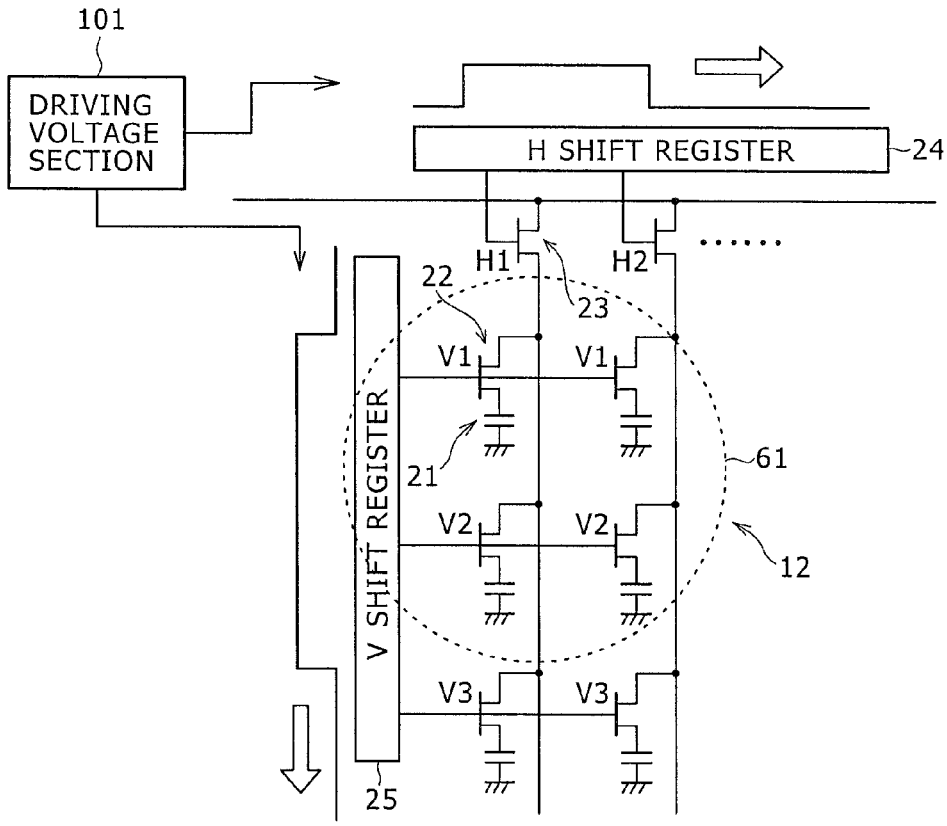
FIG. 10 is a similar view but illustrating a combination method of the vertical pixel simultaneous writing method and the horizontal pixel simultaneous writing method to which the present invention is applied.

The liquid crystal panel may further include a horizontal activation section (for example, particularly an active horizontal pixel number changing section 122 of FIG. 11 in the driving voltage section 101 which applies a pulse voltage to a H shift register 24 as seen in FIG. 10) configured to render the source line common to the M pixels on one vertical line active simultaneously across β ones of the vertical lines, β being an integral value equal to or greater than 1 but equal to or smaller than N.

Figure 9:
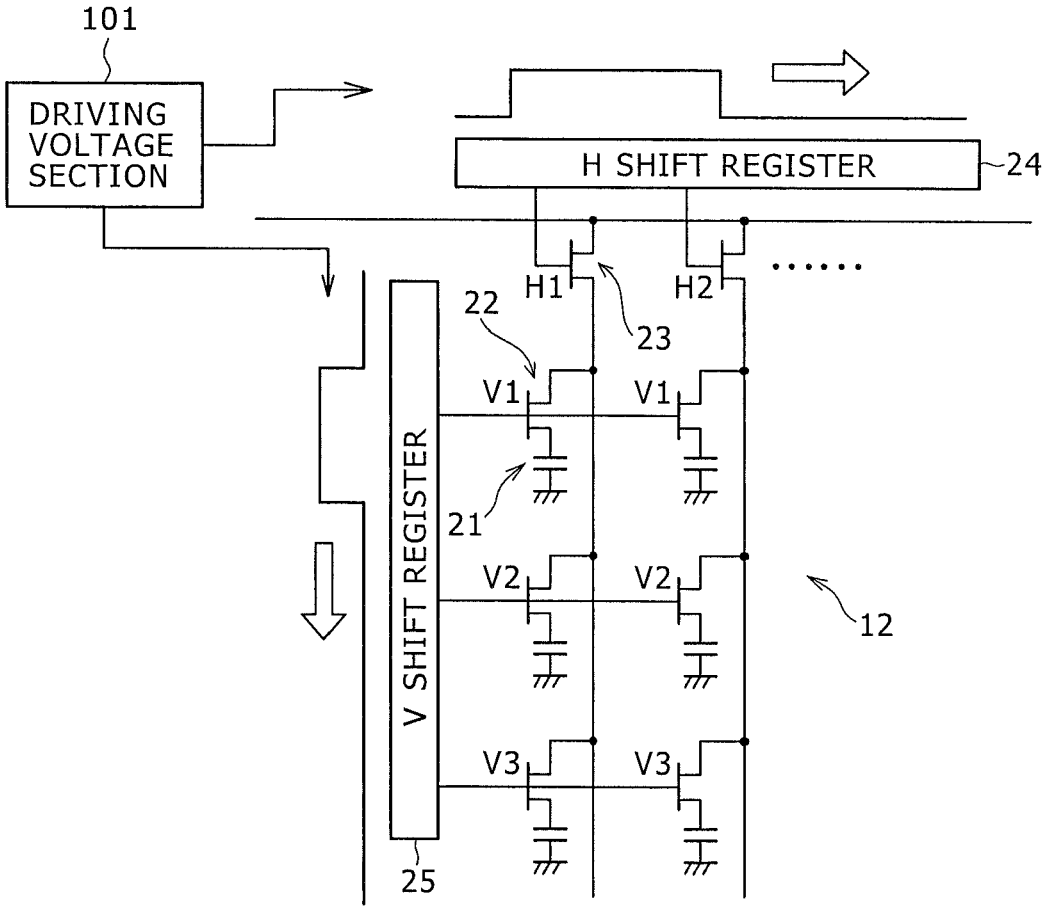
FIG. 9 is a similar view but illustrating a horizontal pixel simultaneous writing method to which the present invention is applied.

According to another embodiment of the present invention, there is provided a liquid crystal panel (for example, a liquid crystal panel 151 of FIG. 11) including a plurality of liquid crystal cells each serving as a pixel (for example, a pixel 21 of FIG. 9) and disposed in a matrix of N horizontal lines and M vertical lines, each of N and M being an integral value equal to or greater than 1, a switching element (for example, a switching element 22 of FIG. 9) provided for each of the pixels and configured to provide a driving voltage to the pixel, the M switching elements which are included in one vertical line having a common source line (for example, common through a switching element 23 of FIG. 9), and a horizontal activation section ((for example, particularly an active horizontal pixel number changing section 122 of FIG. 11 in a driving voltage section 101 which applies a pulse voltage to a H shift register 24 as seen in FIG. 9) configured to render the source line common to the β pixels on one vertical line active simultaneously across p ones of the vertical lines, β being an integral value equal to or greater than 1 but equal to or smaller than N.

Here, in order to facilitate understanding of the present invention, the problem described hereinabove is described more particularly with reference to FIGS. 1 to 7 before the present invention is described specifically.

Figure 1:
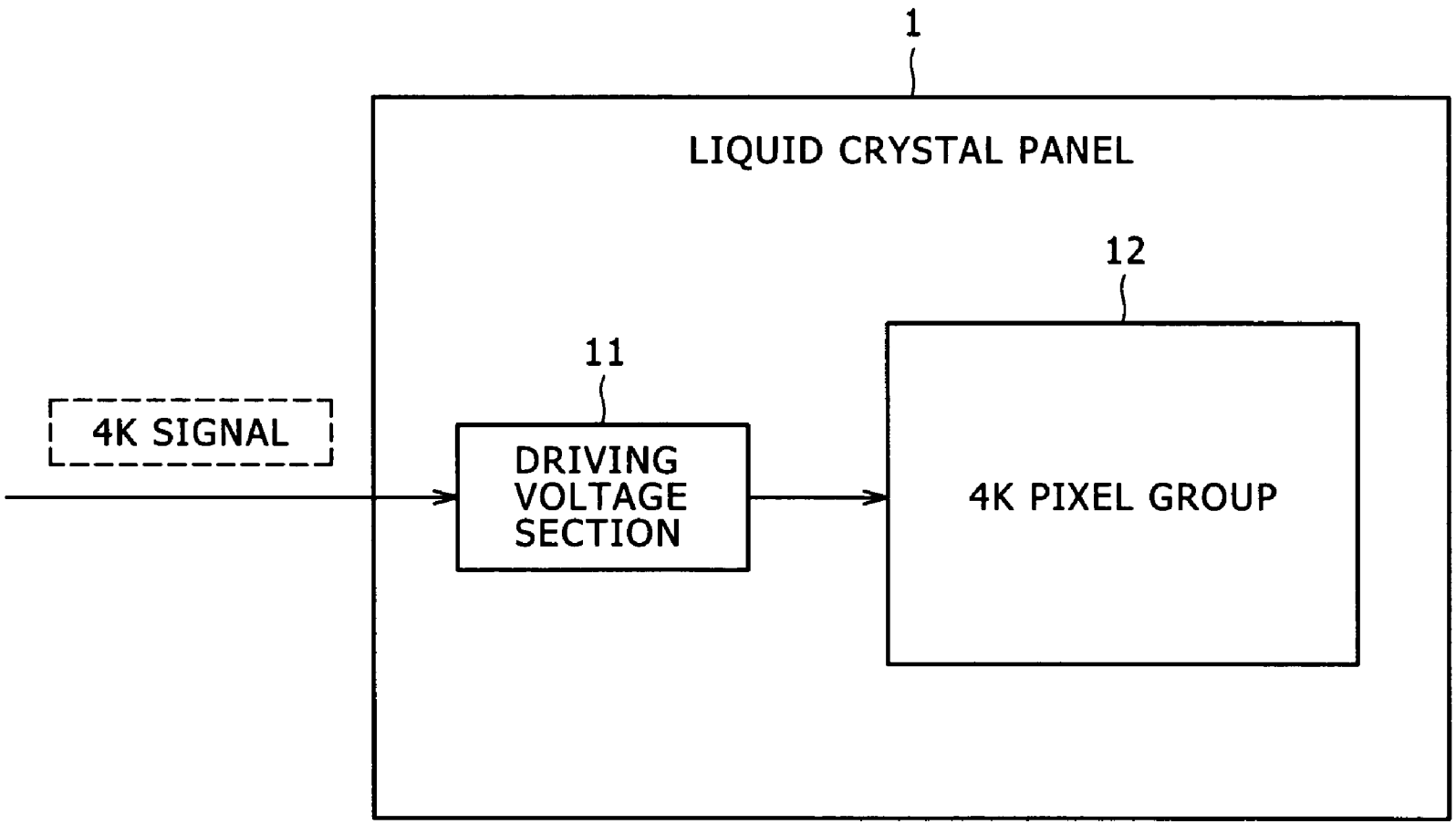
FIG. 1 is a block diagram showing an example of a configuration of a conventional liquid crystal panel for the 4K signal.

FIG. 1 shows an example of a configuration of a conventional liquid crystal panel 1 for the 4K signal. The liquid crystal panel 1 for the 4K signal includes a driving voltage section 11 and a 4K pixel group 12.

Figure 2:
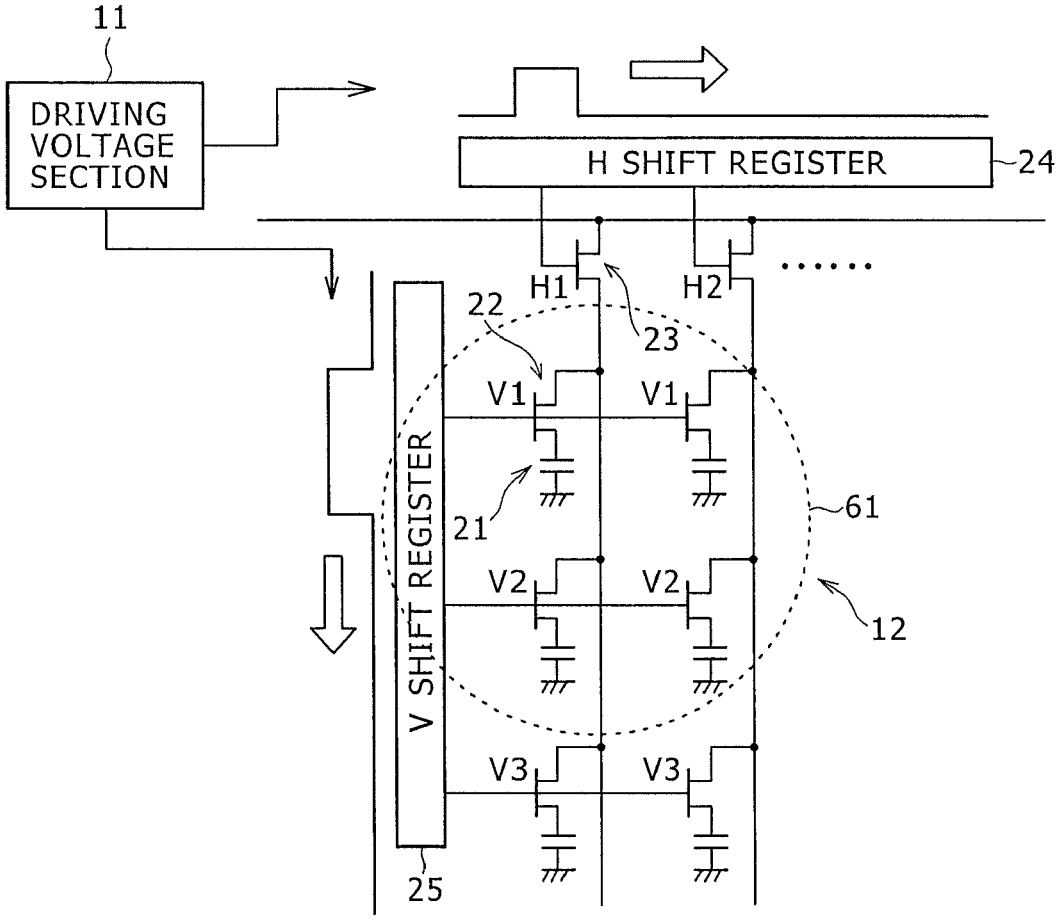
FIG. 2 is a circuit diagram illustrating operation of the liquid crystal panel of FIG. 1.

Part of the 4K pixel group 12 is shown in FIG. 2. Referring to FIG. 2, the 4K pixel group 12 includes 4,096×2,160 liquid crystal cell and holding capacitors 21. It is to be noted that a liquid crystal cell and holding capacitor 21 is hereinafter referred to as pixel 21. The 4K pixel group 12 further includes, for each of the 4,096×2,160 pixels 21, a switching element 22 for providing a driving voltage.

It is to be noted that a vertical line along which the pixels 21 are disposed, that is, in the arrangement of FIG. 2, a line which extends in the vertical direction and along which 2,160 pixels 21 are disposed, is hereinafter referred to as vertical line. In contrast, a line which extends in the horizontal direction and along which the pixels 21 are disposed, that is, in the arrangement of FIG. 21, a horizontal line along which 4,096 pixels 21 are disposed, is hereinafter referred to as horizontal line.

In the 4K pixel group 12, a common source line is provided to the switching elements 22 which provide a driving voltage to the pixels 21 juxtaposed along one vertical line. One switching element 23 is provided for each vertical line for rendering the common source line active. Thus, if a predetermined voltage is applied to a gate line of a switching element 23 on a predetermined vertical line, then the source line of the switching elements 22 on the predetermined vertical line is rendered active. In this instance, the voltage to be applied to the gate line of the switching element 23 is provided as a pulse voltage from the driving voltage section 11 to a horizontal (H) shift register 24. The H shift register 24 successively shifts the pulse voltage in the rightward direction in FIG. 2 in a unit of one vertical line. In particular, the pulse voltage from the driving voltage section 11 is successively shifted to the vertical lines in the H shift register 24. At this time, on the vertical line on which the pulse voltage in the H shift register 24 is positioned, for example, in the example of FIG. 2, on the leftmost vertical line, the source line of all of the switching elements 22 is rendered active.

Further, in the 4K pixel group 12, a common gate line is used for the switching elements 22 which apply a driving voltage to the pixels 21 which are juxtaposed along one horizontal line. In this instance, the voltage applied to the gate line for the switching elements 22 is applied as a pulse voltage from the driving voltage section 11 to a vertical (V) shift register 25 as seen in FIG. 2. The V shift register 25 successively shifts the pulse voltage in the downward direction in FIG. 2 in a unit of one horizontal line. In particular, the pulse voltage from the driving voltage section 11 is successively shifted to the horizontal lines in the V shift register 25. At this time, on the horizontal line on which the pulse voltage is positioned in the V shift register 25, for example, in the example of FIG. 2, on the uppermost horizontal line in FIG. 2, the gate line of all of the switching elements 22 is rendered active.

In the following, operation of the conventional liquid crystal panel 1 for the 4K signal having such a configuration as described above with reference to FIG. 2 is described.

If the 4K signal is an image signal of a unit of a frame or a field (hereinafter referred to simply as field unit), then such a series of operations are successively repeated for every field. In particular, the 4,096×2,160 pixels 21 of a predetermined field are written successively one by one in a predetermined order. Then, after the writing of all pixels 21 comes to an end, and after it is waited that a predetermined interval of time elapses as occasion demands, 4,096×2,160 pixels 21 of a next field are successively written one by one in a predetermined order.

Here, writing of one pixel 21 signifies application of a voltage to the pixel 21 from a corresponding switching element 22. In particular, when the pulse voltage in the H shift register 24 exists at the jth (j is an integral value from among 1 to 4,096) vertical line (hereinafter referred to simply as jth vertical line) from leftwardly and the pulse voltage in the V shift register 25 exists at the kth (k is an integral value from among 1 to 2,160) horizontal line (hereinafter referred to simply as kth horizontal line) from above, both of the gate line and the source line for the switching element 22 positioned on the jth vertical line and the kth horizontal line are rendered active. As a result, the switching element 22 applies a voltage to the pixel 21 positioned on the jth vertical line and the kth horizontal line. As a result, writing into the pixel 21 positioned on the jth vertical line and the kth horizontal line is performed.

Accordingly, when writing of a predetermined field is to be performed, the driving voltage section 11 applies a pulse voltage having a pulse width corresponding to one line to each of the H shift register 24 and the V shift register 25. Thereafter, for example, the driving voltage section 11 holds the pulse voltage for the V shift register 25 at the position of the first horizontal line. Meanwhile, in the H shift register 24, the pulse voltage is successively shifted one by one unit, that is, one by one horizontal line. Consequently, the pixels 21 of the first to 4,096th lines on the first horizontal line are successively written one by one in the order.

After the writing into all pixels 21 of the first horizontal line comes to an end, the pulse voltage in the V shift register 25 is shifted by one unit, that is, to the second horizontal line. Then, the driving voltage section 11 provides the pulse voltage to the H shift register 24 again. Thereafter, for example, in the H shift register 24, the pulse voltage is successively shifted one by one unit, that is, one by one vertical line. Meanwhile, the pulse voltage in the v shift register 25 is kept at the position of the second horizontal line. Consequently, the pixels 21 on the first to 4,096th vertical lines on the second horizontal line are successively written one by one in the order.

Thereafter, the processes described above are repeated. In particular, when all pixels 21 of the k−1th horizontal line comes to an end, the pulse voltage in the V shift register 25 is shifted to the position of the kth horizontal line next to the k−1th horizontal line downwardly, and the pulse voltage is applied from the driving voltage section 11 to the H shift register 24 again. Thereafter, for example, in the H shift register 24, the pulse voltage is successively shifted one by one unit, that is, one by one vertical line. Meanwhile, the pulse voltage in the V shift register 25 is kept at the position of the kth horizontal line. Consequently, the pixels 21 on the first to 4,096th vertical lines on the kth horizontal line are successively written one by one in the order.

In this manner, the conventional liquid crystal panel 1 for the 4K signal writes 4,096×2,160 pixels 21 one by one in a line-sequential fashion. The method of successively writing pixels 21 one by one in this manner is hereinafter referred to as existing one-pixel writing method in order to distinguish the same from a method hereafter described to which the present invention is applied.

It is to be noted that such an existing one-pixel writing method as described above is applied not only to the liquid crystal panel 1 for the 4K signal but also to other existing liquid crystal panels for signals of other resolutions such as, for example, existing liquid crystal panels for the 2K signal.

Here, common application of a liquid crystal panel to the 4K signal and the 2K signal is studied.

In order to apply a liquid crystal panel to both of the 4K signal and the 2K signal, 4,096×2,160 pixels 21 are required. Further, since the resolution of the 2K signal is ¼ that of the 4K signal as described hereinabove, one pixel to the 2K signal corresponds to a block of four pixels adjacent to each other in the vertical and horizontal directions to the 4K signal. Accordingly, when a 2K signal is applied to a liquid crystal panel having 4,096×2,160 pixels 21, writing of one pixel to the 2K signal is writing into four pixels 21 in a block existing at the corresponding position.

In particular, for example, in the example of FIG. 2, in order to perform writing of a pixel in the first horizontal line in the first vertical line of the 2K signal, it is necessary to write four pixels 21 included in a block 61 at the left upper position indicated by a broken line in FIG. 2.

If it is intended to apply the existing one-pixel writing method as it is to implement writing of the 2K signal into such 4,096×2,160 pixels 21, then it is very difficult to adopt the conventional liquid crystal panel 1 for the 4K signal described hereinabove with reference to FIGS. 1 and 2. After all, it is necessary to adopt another liquid crystal panel 31 shown in FIGS. 3 to 7. In other words, only if the existing one-pixel writing method is applied as it is, it is very difficult to apply a liquid crystal panel commonly to the 4K signal and the 2K signal.

Here, the liquid crystal panel 31 shown in FIGS. 3 to 7, that is, the liquid crystal panel 31 which may be adopted in order to use the existing one-pixel writing method to implement writing of the 2K signal into 4,096×2,160 pixels 21, is described briefly.

Figure 3:
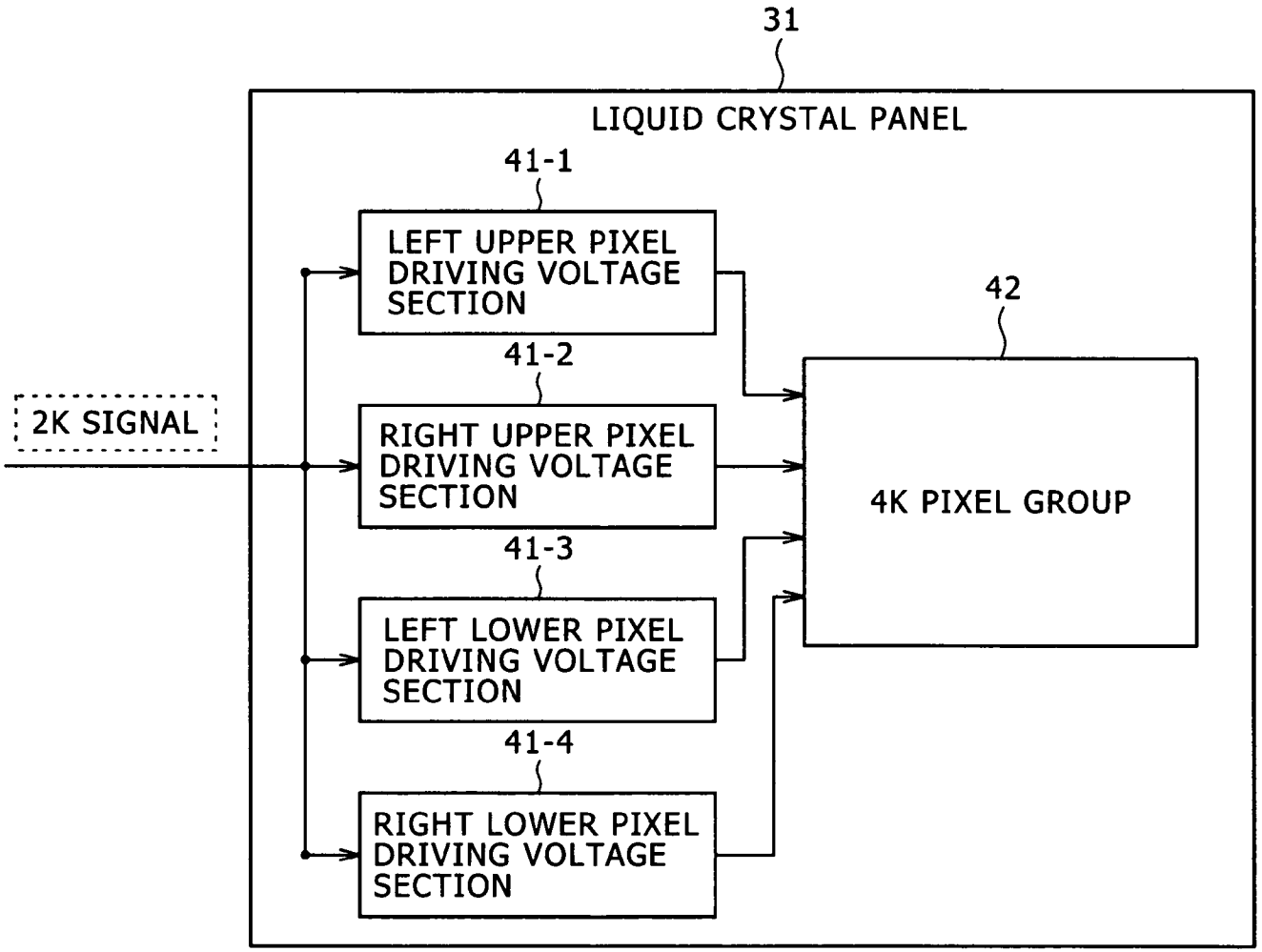
FIG. 3 is a block diagram showing an example of a configuration of a liquid crystal panel implemented where a conventional one-pixel writing method is applied with a resolution equal to that of the liquid crystal panel of FIG. 1 so that the liquid crystal panel is ready for the 2K signal.

In particular, as described hereinabove, one pixel to the 2K signal corresponds to a block of four pixels adjacent to each other in the vertical and horizontal directions to the 4K signal. Therefore, in order to perform writing of one pixel to the 2K signal, a left upper pixel driving voltage section 41-1, a right upper pixel driving voltage section 41-2, a left lower pixel driving voltage section 41-3 and a right lower pixel driving voltage section 41-4 are incorporated in the liquid crystal panel 31 as seen in FIG. 3. The left upper pixel driving voltage section 41-1 applies a writing pulse signal to the right upper pixel in the block. The right upper pixel driving voltage section 41-2 applies the writing pulse signal to the right upper pixel. The left lower pixel driving voltage section 41-3 applies the writing pulse signal to the left lower pixel. The right lower pixel driving voltage section 41-4 applies the writing pulse signal to the right lower pixel.

Figure 4:
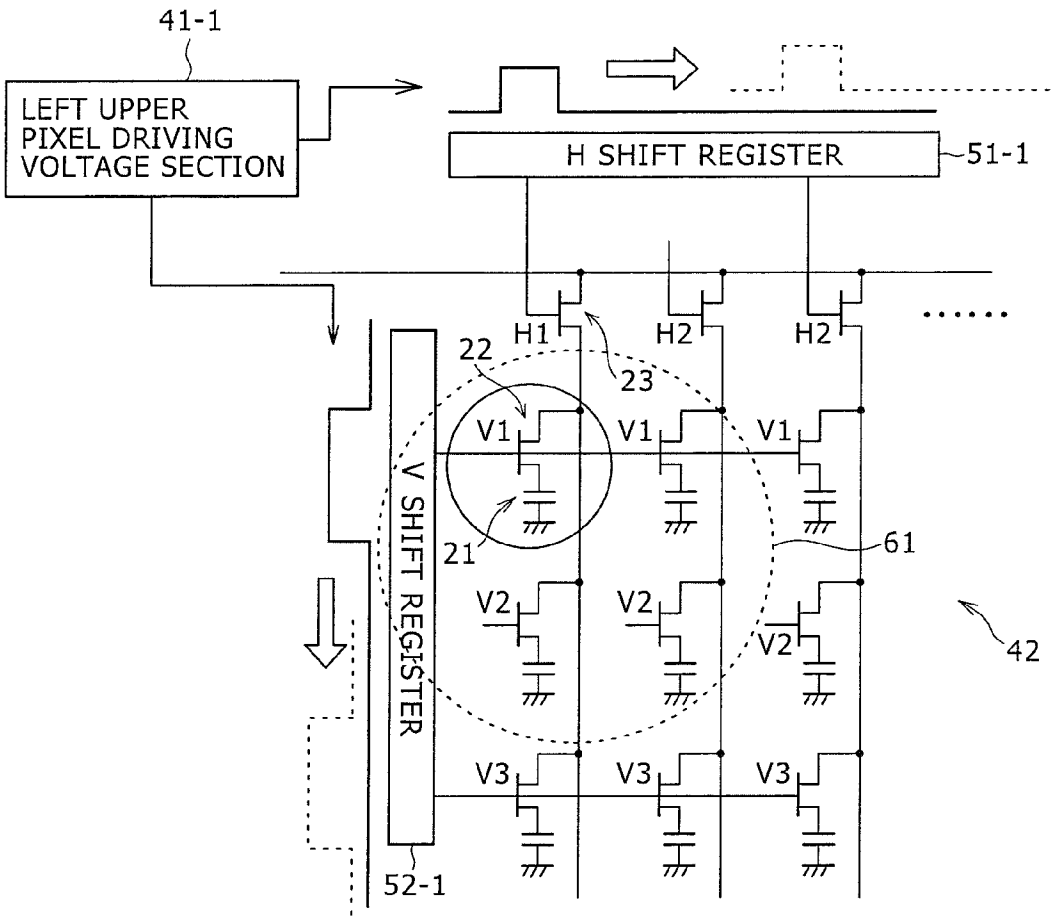
FIGS. 4, 5, 6 and 7 are diagrammatic views illustrating operation of the liquid crystal panel of FIG. 3.
Figure 5:
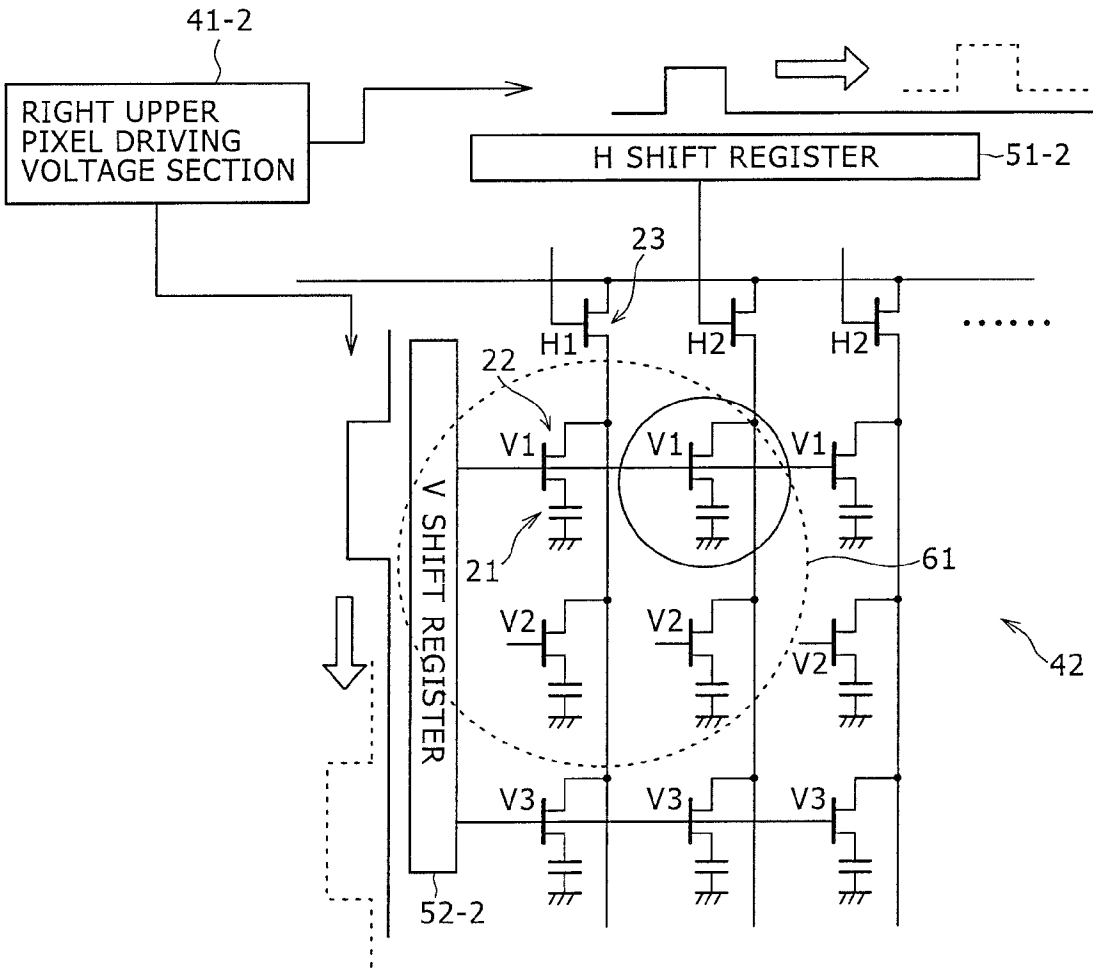
Figure 6:
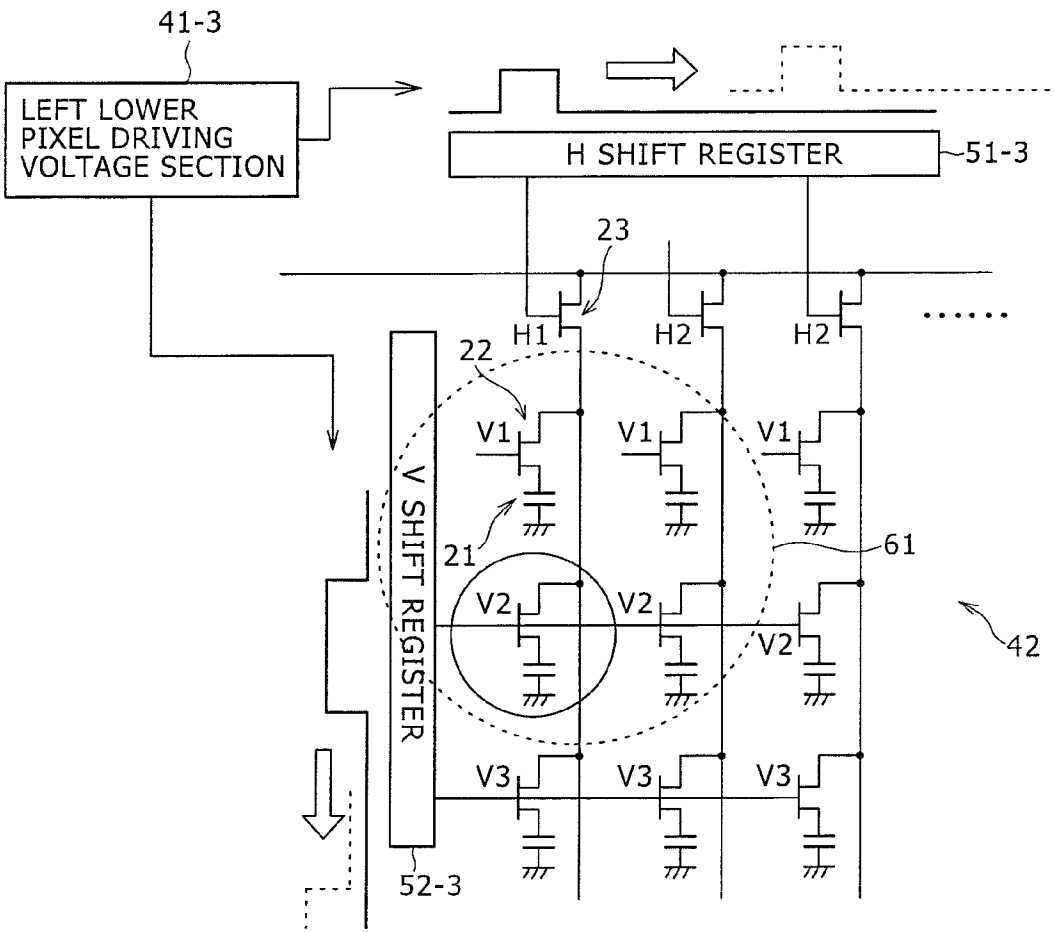
Figure 7:
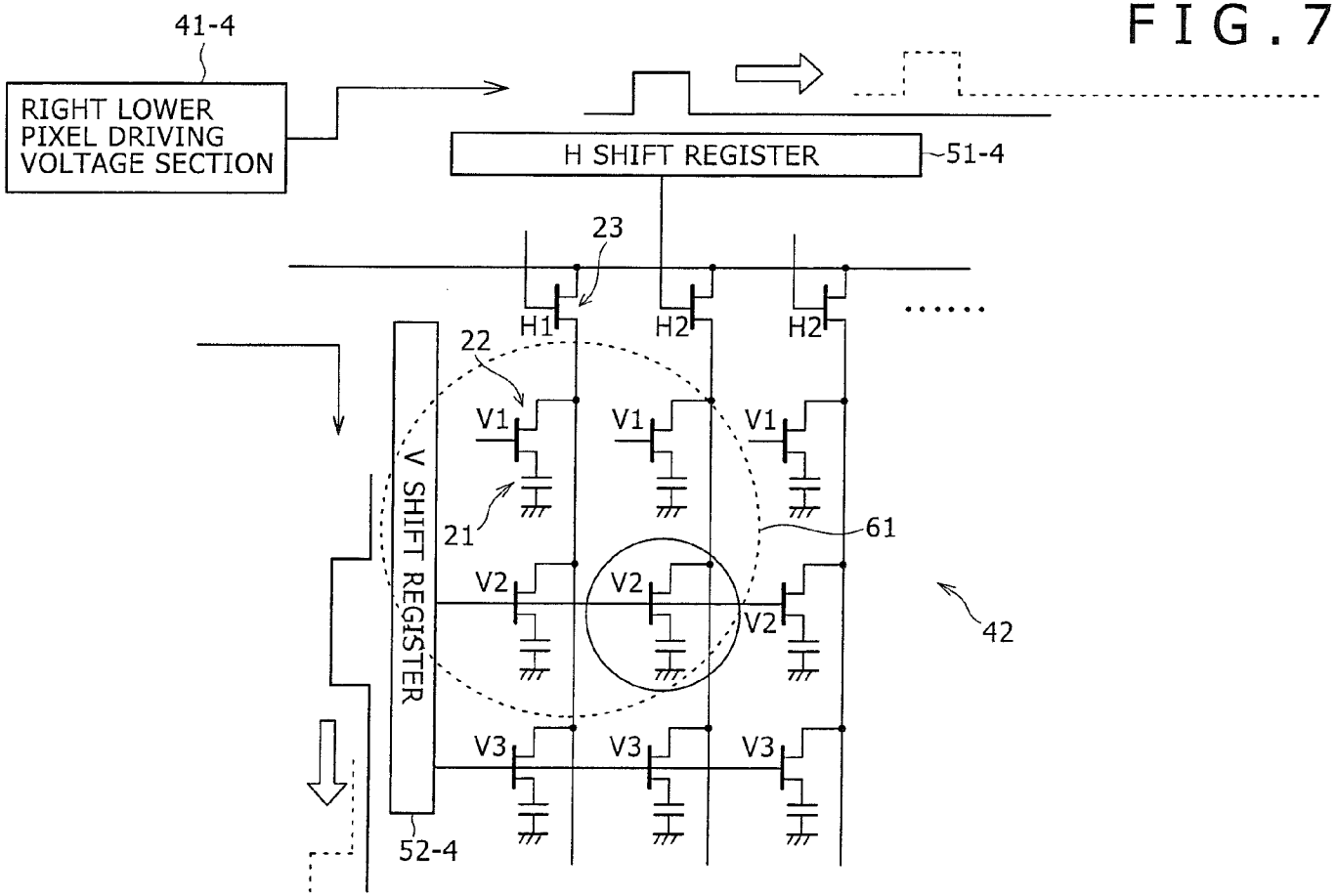

A 4K pixel group 42 having 4,096×2,160 pixels 21 and having such a configuration as shown in FIGS. 4 to 7 is incorporated in the liquid crystal panel 31. As shown in FIG. 4, an H shift register 51-1 and a V shift register 52-1 each for shifting the pulse voltage supplied from the left upper pixel driving voltage section 41-1 are mounted on the liquid crystal panel 31. As shown in FIG. 5, an H shift register 51-2 and a V shift register 52-2 each for shifting the pulse voltage supplied from the right upper pixel driving voltage section 41-2 are mounted on the liquid crystal panel 31. As shown in FIG. 6, an H shift register 51-3 and a V shift register 52-3 each for shifting the pulse voltage supplied from the left lower pixel driving voltage section 41-3 are mounted on the liquid crystal panel 31. As shown in FIG. 7, a H shift register 51-4 and a V shift register 52-4 each for shifting the pulse voltage supplied from the right lower pixel driving voltage section 41-4 are mounted on the liquid crystal panel 31.

In other words, a set of the left upper pixel driving voltage section 41-1, H shift register 51-1 and V shift register 52-1 of FIG. 4, another set of the right upper pixel driving voltage section 41-2, H shift register 51-2 and V shift register 52-2 shown in FIG. 5, a further set of the left lower pixel driving voltage section 41-3, H shift register 51-3 and V shift register 52-3 shown in FIG. 6 and a still further set of the right lower pixel driving voltage section 41-4, H shift register 51-4 and V shift register 52-4 shown in FIG. 7 are incorporated in the liquid crystal panel 31. The sets shown in FIGS. 4, 5, 6 and 7 are hereinafter referred to as left upper pixel writing set, right upper pixel writing set, left lower pixel writing set and right lower pixel writing set, respectively.

As operation of the liquid crystal panel 31 having such a configuration as described above, the above-described operation of the conventional one-pixel writing method is performed basically separately among the left upper pixel writing set, right upper pixel writing set, left lower pixel writing set and right lower pixel writing set.

It is to be noted, however, that all of the H shift registers 51-1 to 51-4 and the V shift registers 52-1 to 52-4 are configured such that the shift units of the pulse voltages thereof are equal to two lines as seen from the pulse voltages indicated by broken lines in FIGS. 4 to 7. In particular, in the H shift registers 51-1 to 51-4, the pulse voltage existing at the position of the j−2th vertical line is shifted to the position of the jth vertical line skipping one vertical line (j−1th vertical line). On the other hand, in the V shift registers 52-1 to 52-4, the pulse voltage existing at the position of the k−2th horizontal line is shifted to the position of the kth horizontal line skipping one horizontal line.

As described above, only if the existing one-pixel writing method is merely applied, it is necessary to adopt liquid crystal panels separate from each other such as the liquid crystal panel 1 (FIGS. 1 and 2) for the 4K signal and the liquid crystal panel (FIGS. 3 to 7) for the 2K signal. In other words, it is very difficult to provide a liquid crystal panel commonly applied to a plurality of signals of different resolutions by merely applying the conventional one-pixel writing method.

Thus, the inventor of the present invention has invented the following method in order to achieve one of aims of the present invention which is to provide a common liquid crystal panel applicable to a plurality of signals of different resolutions such as the 4K signal and the 2K signal. It is to be noted that the reason why the description of "one of aims of the present invention" is used here is that the present invention can be applied to achieve various other aims as hereinafter described, for example, with reference to FIGS. 12 to 16.

The inventor of the present invention has invented a first method that, where a liquid crystal panel wherein liquid crystal cells of pixels are arranged in a matrix such that N (N is an integral value equal to or greater than 1) liquid crystal cells are disposed along a horizontal line and M (M is an integral value equal to or greater than 1) liquid crystal cells are disposed along a vertical line and a switching element for providing a driving voltage to one pixel is provided for each of the pixels is configured such that a common source line is used for M switching elements included in one vertical line, gate lines of $\alpha$ ($\alpha$ is an integral value equal to or greater than 1 but equal to or smaller than M) switching elements from among the M switching elements included in the one vertical line are rendered active at the same time. In this instance, by setting $\alpha$ to $\alpha$=2 or more, simultaneous writing into the $\alpha$ pixels included in the same vertical line can be performed. Therefore, the first method is hereinafter referred to as vertical pixel simultaneous writing method.

Further, the inventor of the present invention has made a second method that, where the liquid crystal panel is configured in such a manner as described above, the source line common to one vertical line is rendered active at the same time across $\beta$ ($\beta$ is an integral value equal to or greater than 1 but equal to or smaller than N) vertical lines, that is, $\beta$ source lines are rendered active at the same time. In this instance, by setting $\beta$ to $\beta$=2 or more, simultaneous writing into the $\beta$ pixels included in the same horizontal line can be performed. Therefore, the second method is hereinafter referred to as horizontal pixel simultaneous writing method.

FIG. 8 illustrates an example of an application of the vertical pixel simultaneous writing method wherein the conventional 4K pixel group 12 (FIG. 1) is used as it is. FIG. 9 illustrates an example of an application of the horizontal pixel simultaneous writing method wherein the conventional 4K pixel group 12 is used as it is. The vertical pixel simultaneous writing method and the horizontal pixel simultaneous writing method are described more particularly below with reference to FIGS. 8 and 9.

In the application example of FIG. 8, a driving voltage section 101 to which the vertical pixel simultaneous writing method is applied is used in place of the driving voltage section 11 (FIG. 1). The driving voltage section 101 has a function capable of varying the pulse width of the pulse voltage to be applied to the V shift register 25. It is to be noted, however, that, in the application example of FIG. 8, the number $\alpha$ is $\alpha$=2, that is, simultaneous writing into two pixels 21 included in the same vertical line is performed. Therefore, in the application example of FIG. 8, a pulse voltage having a pulse width corresponding to two lines is applied to the V shift register 25. As a result, the following operation can be carried out.

When writing of a predetermined field is to be performed, the driving voltage section 101 applies a pulse voltage having a pulse width corresponding to one line to the H shift register 24 but applies a pulse voltage having another pulse width corresponding to two lines to the V shift register 25. Thereafter, the driving voltage section 101 keeps the pulse width of the V shift register 25 at the positions of the first and second horizontal lines. Meanwhile, the driving voltage section 101 successively shifts the pulse voltage in the H shift register 24 in a unit corresponding to one vertical line. As a result, the pixels 21 on the first to 4,096th vertical lines on the first horizontal line and the second horizontal line are successively written simultaneously two by two in the order. In other words, on the jth vertical line, simultaneous writing of the pixel 21 on the first horizontal line and the pixel 21 on the second horizontal line is performed successively.

At a time when two-pixel simultaneously writing of all of the pixels 21 on the first and second horizontal lines comes to an end, the V shift register 25 shifts the pulse voltage in a unit of two horizontal lines. In particular, the V shift register 25 shifts the pulse voltage to the positions of the third and fourth horizontal lines. Then, the driving voltage section 101 applies a pulse voltage having a pulse width corresponding to one line to the H shift register 24 again. Thereafter, the H shift register 24 successively shifts the pulse voltage having a width corresponding to one line one by one vertical line. Meanwhile, the pulse voltage of the V shift register 25 is held at the positions of the third and fourth horizontal lines. Consequently, the pixels 21 on the first to 4,096th vertical lines on the third and fourth horizontal lines are written successively two by two in the order. In other words, for the jth vertical line, simultaneous writing into the pixel 21 on the third horizontal line and the pixel 21 on the fourth horizontal line is successively performed.

Thereafter, the processes described above are repeated. In particular, at a point of time at which two-pixel simultaneous writing of all of the pixels 21 on the k−2th (k is an odd-number value) horizontal line and the k−1th horizontal line is completed, the pulse voltage in the V shift register 25 is shifted to the positions of the kth horizontal line and the k+1th horizontal line which are lower by two line distances than the first-mentioned horizontal lines. Then, a pulse voltage having a pulse width corresponding to one line is applied again from the driving voltage section 101 to the H shift register 24. Thereafter, for example, in the H shift register 24, the pulse voltage corresponding to one line is successively shifted one by one vertical line. In the mean time, the pulse voltage in the V shift register 25 is kept at the positions of the kth and k+1th horizontal lines. Consequently, the pixels 21 on the first to 4,096th vertical lines on the kth and k+1th horizontal lines are successively written simultaneously two by two in the order. In other words, on the jth vertical line, simultaneous writing of the pixel 21 on the kth horizontal line and the pixel 21 on the k+1th horizontal line is successively performed.

While, in the example of FIG. 8, the number $\alpha$ is $\alpha$=2, where the number $\alpha$ is set to 3 or more, the pulse voltage to be applied from the driving voltage section 101 to the V shift register 25 has a pulse width corresponding to a lines, and the shift unit in the V shift register 25 is $\alpha$ lines. As a result, on the same vertical line, simultaneous writing of a pixels adjacent each other in the vertical direction is performed.

While the application example of FIG. 8 has such a configuration as described above, the application example of FIG. 9 uses the driving voltage section 101 to which the horizontal pixel simultaneous writing method is applied in place of the driving voltage section 11 shown in FIG. 1. The driving voltage section 101 has a function capable of varying the pulse width of the pulse voltage to be applied to the H shift register 24. It is to be noted, however, that, in the application example of FIG. 9, the number $\beta$ is $\beta$=2, that is, simultaneous writing into two pixels 21 included in the same horizontal line is performed. Therefore, in the application example of FIG. 9, a pulse voltage having a pulse width corresponding to two lines is applied to the H shift register 24. As a result, the following operation can be carried out.

When writing of a predetermined field is to be performed, the driving voltage section 101 applies a pulse voltage having a pulse width corresponding to two lines to the H shift register 24 but applies a pulse voltage having another pulse width corresponding to two lines to the V shift register 25. Thereafter, the driving voltage section 101 causes the H shift register 24 to successively shift the pulse voltage in a unit corresponding to two horizontal lines. Meanwhile, the driving voltage section 101 keeps the pulse voltage of the V shift register 25 at the position of the first horizontal line. As a result, the two pixels 21 adjacent each other in the horizontal direction on the first horizontal line are successively written in the order of the first to 4,096th vertical lines. In other words, on the first horizontal line, simultaneous writing of the pixel 21 on the jth (j is an odd number value) vertical line and the pixel 21 on the j+1th vertical line is performed successively.

At a point of time at which two-pixel simultaneously writing of all of the pixels 21 on the first horizontal line comes to an end, the V shift register 25 shifts the pulse voltage in a unit of one horizontal line. In particular, the V shift register 25 shifts the pulse voltage to the position of the second horizontal line. Then, the driving voltage section 101 applies a pulse voltage having a pulse width corresponding to two lines to the H shift register 24 again. Thereafter, the H shift register 24 successively shifts the pulse voltage having a width corresponding to two lines two by two vertical lines. Meanwhile, the pulse voltage of the V shift register 25 is held at the position of the second horizontal line. Consequently, the two pixels 21 adjacent each other in the horizontal direction on the second horizontal line are successively written simultaneously in the order of the first to 4,096th vertical lines. In other words, for the second horizontal line, simultaneous writing into the pixel 21 on the jth (j is an odd number value) vertical line and the pixel 21 on the j+1th vertical line is successively performed in the order.

Thereafter, the processes described above are repeated. In particular, at a point of time at which two-pixel simultaneous writing of all of the pixels 21 on the k−1th horizontal line comes to an end, the pulse voltage in the V shift register 25 is shifted to the position of the kth horizontal line just below the first-mentioned horizontal line. Then, a pulse voltage having a pulse width corresponding to two lines is applied again from the driving voltage section 101 to the H shift register 24. Thereafter, for example, in the H shift register 24, the pulse voltage corresponding to two lines is successively shifted two by two horizontal lines. In the meantime, the pulse voltage in the H shift register 24 is kept at the positions of the kth and k+1th horizontal lines. Consequently, the two pixels 21 adjacent each other in the horizontal direction on the kth horizontal line are successively written simultaneously in the other of the first to 4,096th vertical lines. In other words, on the kth horizontal line, simultaneous writing of the pixel 21 on the jth (j is an odd number value) vertical line and the pixel 21 on the j+1th horizontal line is successively performed in the order.

While, in the application example of FIG. 9, the number $\beta$ is $\beta=2$, where the number $\beta$ is set to 3 or more, the pulse voltage to be applied from the driving voltage section 101 to the H shift register 24 has a pulse width corresponding to $\beta$ lines, and the shift unit in the H shift register 24 is $\beta$ lines. As a result, on the same horizontal line, simultaneous writing of $\beta$ pixels adjacent each other in the horizontal direction is performed.

The vertical pixel simultaneous writing method and the horizontal pixel simultaneous writing method can be used in combination. In particular, also it is possible to implement a driving voltage section 101 to which both of the vertical pixel simultaneous writing method and the horizontal pixel simultaneous writing method are applied. In this instance, simultaneous writing of a block composed of $\beta$ pixels can be achieved.

In particular, for example, if the numbers $\alpha$ and $\beta$ are set to $\alpha=2$ and $\beta=2$, respectively, then combination operation of the operation of the application example of FIG. 8 and the operation of the application example of FIG. 9 described hereinabove, that is, such operation as in an example of FIG. 10, can be achieved. In other words, simultaneous writing of a block 61 composed of 2×2 pixels 21 can be performed. This signifies that the conventional 4K pixel group 12 including 4,096×2,160 pixels 21 as described above can be used as it is to achieve writing of the 2K signal. In other words, if a liquid crystal panel 151 including a driving voltage section 101 to which both of the vertical pixel simultaneous writing method and the horizontal pixel simultaneous wring method are applied and a conventional 4K pixel group 12 including 4,096×2,160 pixels 21 is adopted as seen in FIG. 11, then the liquid crystal panel 151 is ready for both of the 4K signal and the 2K signal. In particular, the liquid crystal panel 151 of FIG. 11 is a form of a liquid crystal panel to which the present invention is applied and which is ready for a plurality of signals of different resolutions such as the 2K signal and the 4K signal. Accordingly, if the liquid crystal panel 151 of FIG. 11 is adopted, then common application of a panel, for example, to the 2K signal and the 4K signal can implemented.

More particularly, in the driving voltage section 101, the vertical pixel simultaneous writing method is applied to an active vertical pixel number changing section 121 while the horizontal pixel simultaneous writing method is applied to an active horizontal pixel number changing section 122. In other words, a driving voltage generator 123 applies a pulse voltage having a predetermined pulse width to each of the H shift register 24 and the V shift register 25 (FIGS. 8 to 10). In this instance, the active horizontal pixel number changing section 122 is a block which changes the pulse width of the pulse voltage to be applied to the H shift register 24, that is, the horizontal simultaneous writing number $\beta$. Meanwhile, the active vertical pixel number changing section 121 is a block which changes the pulse width of the pulse voltage to be applied to the V shift register 25, that is, the vertical simultaneous writing number $\alpha$.

It is to be noted that operation itself of the liquid crystal panel 151 is given hereinabove with reference to FIGS. 8 to 10, and therefore, the description of the operation is omitted herein to avoid redundancy.

Further, in the arrangement of FIG. 11, the active vertical pixel number changing section 121 and the active horizontal pixel number changing section 122 are provided in the driving voltage section 101 so that the vertical pixel simultaneous writing method and the horizontal pixel simultaneous wring method can be applied in combination. However, the vertical pixel simultaneous writing method and the horizontal pixel simultaneous wring method are independent methods of each other as described hereinabove and need not necessarily be applied in combination. In other words, the liquid crystal panel to which the present invention is applied may be implemented not only as such a liquid crystal panel 151 as described above but also as a liquid crystal panel to which only the vertical pixel simultaneous writing method is applied or another liquid crystal panel to which only the horizontal pixel simultaneous wring method is applied. In this instance, in the former liquid crystal panel, a driving voltage section including the active vertical pixel number changing section 121 and the driving voltage generator 123 is incorporated. On the other hand, in the latter liquid crystal panel, a driving voltage section including the active horizontal pixel number changing section 122 and the driving voltage generator 123 is incorporated.

Incidentally, the liquid crystal panel to which the present invention is applied, for example, the liquid crystal panel 151 of FIG. 11, can be utilized not only for a common application to a plurality of signals of different resolutions but also for various other applications.

Figure 12:
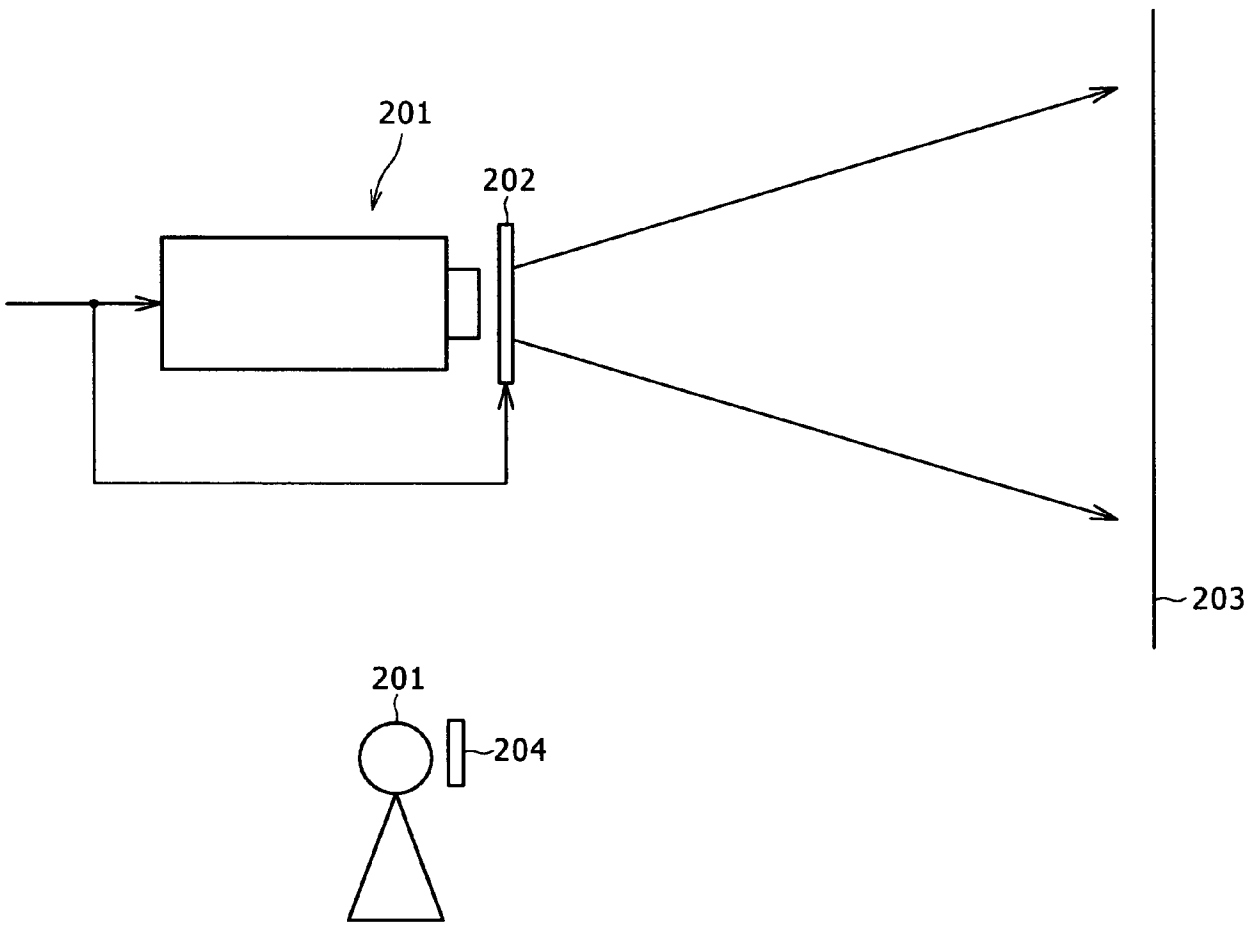
FIG. 12 is a schematic view showing an example of a configuration of a 3D image system to which the liquid crystal panel of FIG. 11 is applied.

For example, the liquid crystal panel 151 can be applied to such a 3D (3-Dimensional) image system as shown in FIG. 12.

Referring to FIG. 12, the 3D image system shown includes a projector apparatus 201 in which, for example, the liquid crystal panel 151 of FIG. 11 is built, a liquid crystal shutter 202, a screen 203 and polarizing glasses 204. A number of pairs of polarizing glasses 204 equal to the number of viewers 205 are prepared.

An image signal corresponding to a 3D image is provided, for example, in a unit of a field to the projector apparatus 201, and at least part of the image signal is supplied to the liquid crystal shutter 202 in order to perform synchronous changeover for each field.

The projector apparatus 201 successively projects light fluxes corresponding to the individual field to the screen 203 so that respective field images are formed on the screen 203. Thereupon, each light flux to the screen 203 is polarized by the liquid crystal shutter 202 so that the field image may be recognized by one of the eyes of each viewer 205 who wears the polarizing glasses 204 It is to be noted that, in the following description, such polarization operation of the liquid crystal shutter 202 as just described is referred to as open the liquid crystal shutter 202 of one eye. Thereupon, the opening and closing operations of the liquid crystal shutter 202 of one eye are performed in synchronism with a field in accordance with at least part of the image signal as described above.

Figure 13:
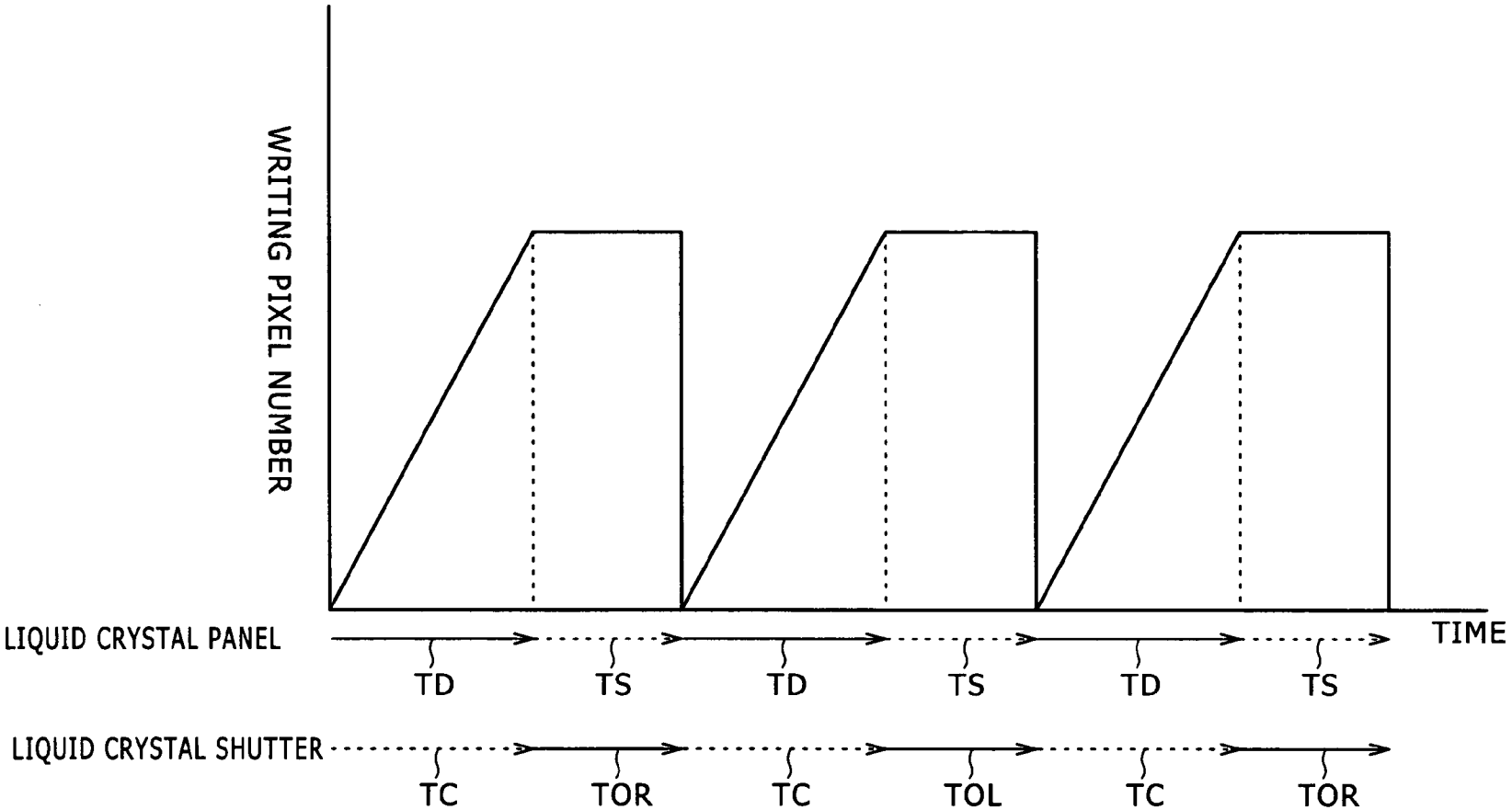
FIG. 13 is a diagram illustrating operation of the 3D image system of FIG. 12.

In particular, as seen in FIG. 13, the projector apparatus 201 (in FIG. 13, represented as liquid crystal panel) performs total writing of pixels for one field within a period TD. Within a period TC corresponding to the period TD, the liquid crystal shutter 202 remains closed. Then, for a predetermined period TOR after lapse of the period TC, the liquid crystal shutter 202 of one eye (for example, the right eye) opens. Then within a period TS corresponding to the period TOR, irradiation of light fluxes for one field on the screen 203 by the projector apparatus 201 is retained. As a result, a field image formed on the screen 203 is recognized as a one-eye image (for example, right-eye image) by the viewer 205.

Within a period TC after lapse of the period TOR, the liquid crystal shutter 202 closes again. Within a period TD corresponding to the period TC, the projector apparatus 201 performs total writing of pixels for one field for a one-eye image on the opposite side (for example, left-eye image). Within a period TC corresponding to the period TD, the liquid crystal shutter 202 remains closed. Then, only within a predetermined period TOL after lapse of the period TC, the liquid crystal shutter 202 of one eye on the opposite side (for example, the left eye) opens. Then, within a period TS corresponding to the period TOR, irradiation of light fluxes for one field on the screen 203 by the projector apparatus 201 is retained. As a result, a field image formed on the screen 203 is recognized as a one-eye image (foe example, left eye image) by the viewer 205.

Consequently, the viewer 205 who wears the polarizing glasses 204 can recognize the two field images formed successively on the screen 203 as a 3D image.

Thereafter, the series of processes described above is executed repetitively for each frame. As a result, the viewer 205 who wears the polarizing glasses 204 can recognize that a 3D image is displayed on the screen 203.

However, in order to allow the viewer 205 to recognize the frame image as a 3D image, a luminance higher than a fixed level is required, and in order to assure the luminance, the period TS (hereinafter referred to as retaining period TS) corresponding to the retaining time of irradiation of light fluxes for one field on the screen 203 by the projector apparatus 201 is preferably set to a long period. This is because the luminance is represented by TS/2(TD+TS) and TD+TS is fixed as the changeover period of time between fields. More particularly, this is because, if the writing speed of all pixels for one field of the projector apparatus 201 is higher, then the period TD (hereinafter referred to as writing period TD) required for writing is shorter as much, and as a result, a long period of time is assured for the retaining period TS and an increased luminance is obtained thereby.

In order to assure a long period of time for the retaining period TS, that is, in order to reduce the writing period TD, the projector apparatus 201 which incorporates the liquid crystal panel of the present invention by which a plurality of pixels can be written simultaneously, for example, the liquid crystal panel 151, is adopted.

Figure 14:
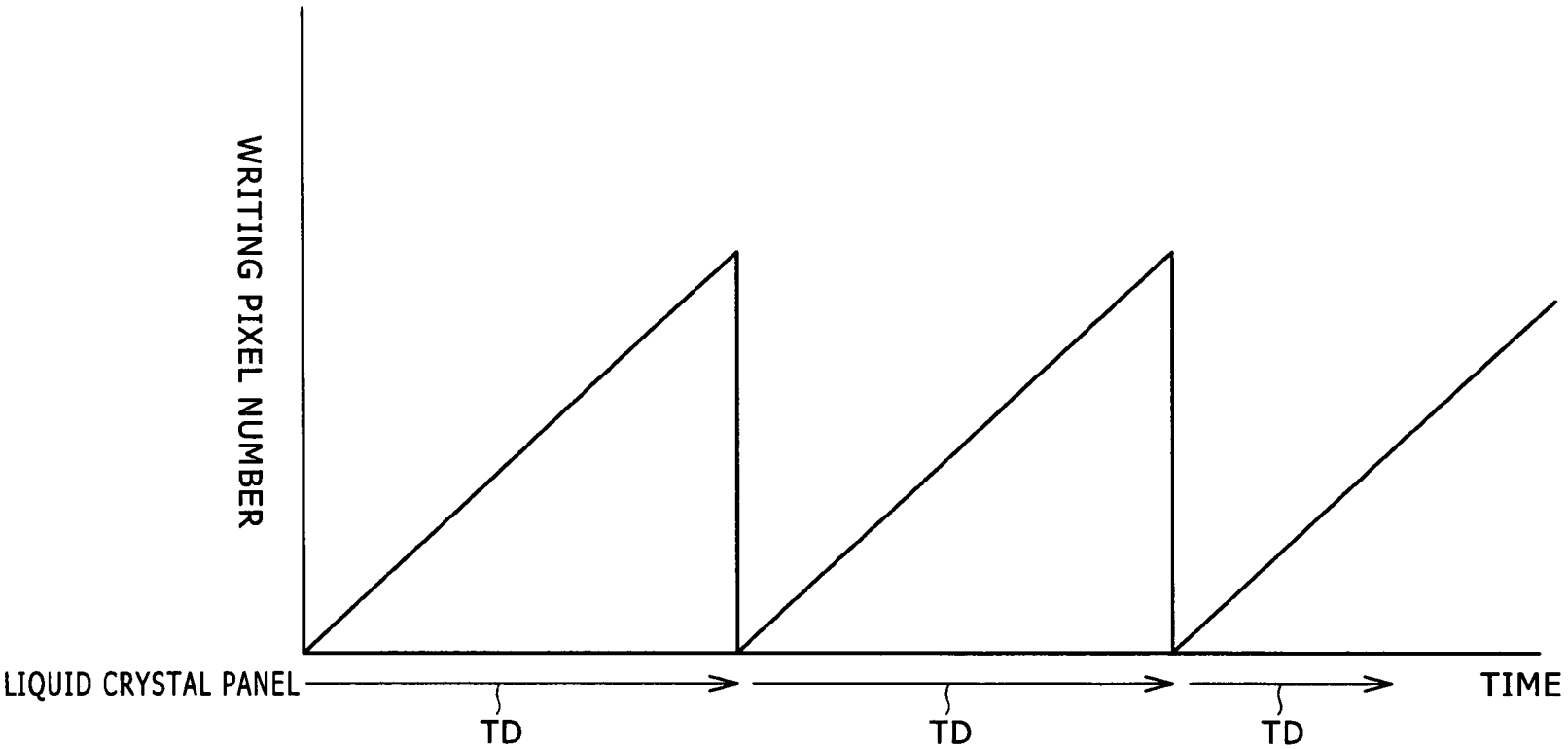
FIG. 14 is a diagram illustrating operation of another 3D image system to which a conventional liquid crystal panel is applied in place of the liquid crystal panel of FIG. 11.

In other words, if it is tried to utilize only one projector apparatus in which a conventional liquid crystal panel such as the liquid crystal panel 1 of FIG. 1 is incorporated in place of the projector apparatus 201 in which the liquid crystal panel 151 or the like is incorporated to implement such a 3D image system as described hereinabove with reference to FIG. 12, then assurance of the retaining period TS is very difficult as seen from FIG. 14. This is because, since, in the conventional liquid crystal panel, simultaneous writing of a plurality of pixels cannot be performed but pixels are written one by one, the wring speed of all pixels for one field is naturally lower than that of the projector apparatus 201 to which the present invention is applied. Accordingly, an image projected on the screen 203 by the projector apparatus in which the conventional liquid crystal panel is incorporated is very low in luminance and cannot be visually observed as a 3D image by the viewer 205.

In summary, it is very difficult to implement such a 3D image system as shown in FIG. 12 even if one projector apparatus in which a conventional liquid crystal panel is incorporated is adopted, but in order to implement such a 3D image system as described above, it is necessary to adopt the projector apparatus 201 in which the liquid crystal panel to which the present invention is applied such as the liquid crystal panel 151 is incorporated.

Figure 15:
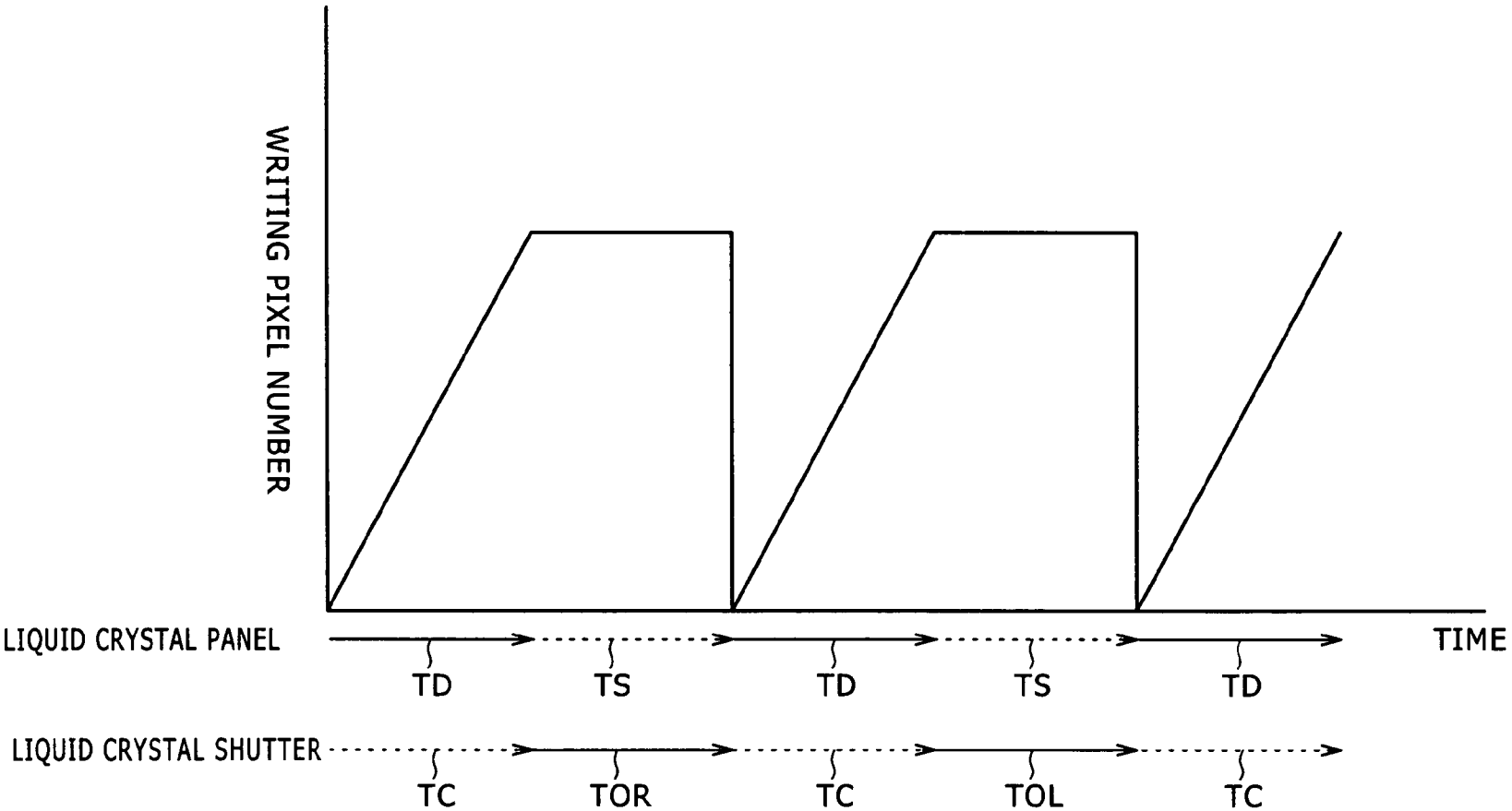
FIG. 15 is a diagram illustrating operation of the 3D image system of FIG. 12 where either one of the vertical pixel simultaneous writing method and the horizontal pixel simultaneous writing method is adopted for comparison with the operation of FIG. 14.

In particular, if such a projector apparatus 201 as just described performs two-pixel simultaneous writing in the horizontal direction or the vertical direction, for example, in such a manner as illustrated in FIG. 15, then the writing speed of all pixels for one field increases to approximately two times that of writing for every one pixel of the conventional projector apparatus. In this instance, as apparent from comparison between FIGS. 14 and 15, also the writing period TD decreases to approximately one half, and also the retaining period TS is assured as much. As a result, the luminance increases as much.

Figure 16:
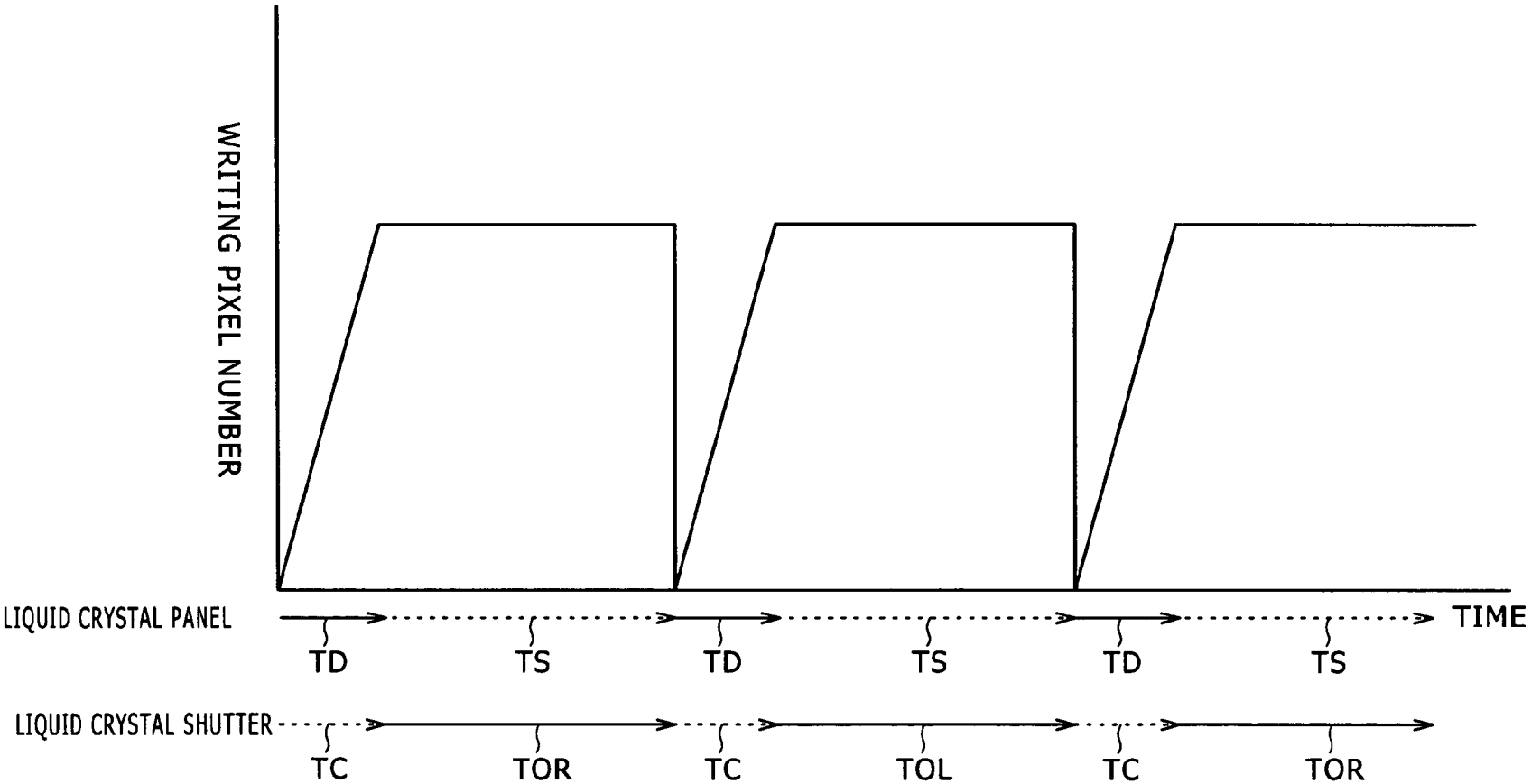
FIG. 16 is a diagram illustrating operation of the 3D image system of FIG. 12 where the combination method of the vertical pixel simultaneous writing method and the horizontal pixel simultaneous writing method is adopted for comparison with the operation of FIGS. 14 and 15.

Furthermore, if the projector apparatus 201 of the present invention performs, for example, four-pixel simultaneous writing in the horizontal and vertical directions as seen in FIG. 16, then the writing speed of all pixels for one field increases to approximate four times when compared with that by writing for every one pixel by the conventional projector apparatus. In this instance, as apparent from comparison between FIGS. 14 and 16, also the writing period TD decreases to approximately one fourth, and also the retaining period TS is assured as much. As a result, also the luminance increases as much. In other words, since the projector apparatus 201 of the present invention performs four-pixel simultaneous writing in the horizontal and vertical directions, a further higher luminance can be obtained when compared with that in the case wherein two-pixel simultaneous writing in the horizontal direction or the vertical direction is performed.

While the series of processes including also the display process described above can be executed by hardware, it may otherwise be executed by software.

Where the series of processes described above are executed by software, the liquid crystal panel to which the present invention is applied can be configured, for example, so as to include a computer shown in FIG. 1. Or, driving of the liquid crystal panel to which the present invention is applied may be controlled by the computer of FIG. 17.

Figure 17:
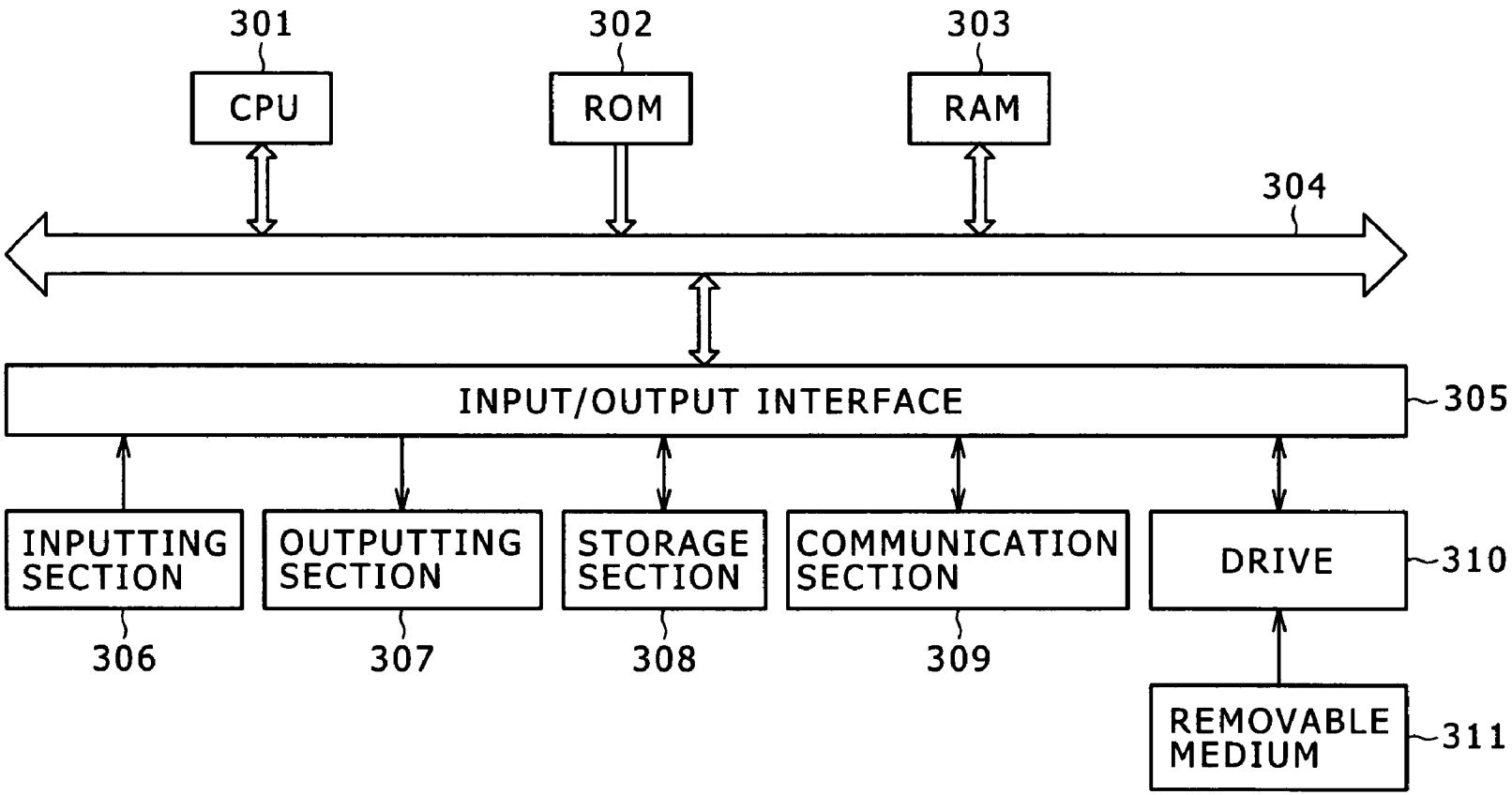
FIG. 17 is a block diagram showing an example of a configuration of a computer which is included in or controls driving of a liquid crystal panel to which the present invention is applied.

Referring to FIG. 17, a CPU (central processing unit) 301 executes various processes in accordance with a program recorded in a ROM (Read Only Memory) 302 or a program loaded from a storage section 308 into a RAM (Random Access Memory) 303. Also data necessary for the CPU 301 to execute the processes are suitably stored into the RAM 303.

The CPU 301, ROM 302 and RAM 303 are connected to one another by a bus 304. Also an input/output interface 305 is connected to the bus 304.

An inputting section 306 including a keyboard, a mouse and so forth, an outputting section 307 including a display unit and so forth, a storage section 308 formed from a hard disk or the like, and a communication section 309 including a modem, a terminal adapter and so forth are connected to the input/output interface 305. The communication section 309 controls a communication process to be performed with another apparatus (not shown) through a network including the Internet.

Further, as occasion demands, a drive 310 is connected to the input/output interface 305. A removable medium 311 such as a magnetic disk, an optical disk, a magneto-optical disk, a semiconductor memory or the like is suitably loaded into the drive 310, and a computer program read from the loaded medium is installed into the storage section 308 as occasion demands.

Where the series of processes is executed by software, a program which constructs the software is installed from a network, a recording medium or the like into a computer incorporated in hardware for exclusive use or, for example, a personal computer for universal use which can execute various functions by installing various programs.

Such a recording medium including a program as just described may be formed as a removable recording medium (package medium) 311 which may be, as shown in FIG. 17, a magnetic disk (including a floppy disk), an optical disk (including a CD-ROM (Compact Disc-Read Only Memory) and a DVD (Digital Versatile Disk)), a magneto-optical disk (including an MD (Mini-Disc)), or a semiconductor memory which has the program recorded thereon or therein and is distributed in order to provide the program to a user separately from an apparatus body, or as a ROM 302 or a hard disk included in the storage section 308 which has the program recorded therein or thereon and is provided to a user in a state wherein it is incorporated in an apparatus body in advance.

It is to be noted that, in the present specification, the steps which describe the program recorded in or on a recording medium may be but need not necessarily be processed in a time series in the order as described, and include processes which are executed parallelly or individually without being processed in a time series.

Further, in the present specification, the term "system" is used to represent an entire apparatus composed of a plurality of apparatus.

While a preferred embodiment of the present invention has been described using specific terms, such description is for illustrative purpose only, and it is to be understood that changes and variations may be made without departing from the spirit or scope of the following claims.

What is claimed is:

1. A liquid crystal panel, comprising:

a plurality of liquid crystal cells each serving as a pixel and disposed in a matrix of M horizontal lines and N vertical lines, N being an integral value equal to or greater than 1 and M being an integral value greater than 1;

a switching element provided for each of said pixels and configured to provide a driving voltage to the pixel;

the M switching elements which are included in one vertical line having a common source line; and a vertical activation section configured to render gate lines of $\alpha$ ones of the M switching elements included in one vertical line active simultaneously, $\alpha$ being an integral value greater than 1 but equal to or smaller than M.

2. The liquid crystal panel according to claim 1, further comprising a horizontal activation section configured to render the source line common to the M pixels on one vertical line active simultaneously across $\beta$ ones of the vertical lines, $\beta$ being an integral value equal to or greater than 1 but equal to or smaller than N.

3. A driving method for a liquid crystal panel which includes a plurality of liquid crystal cells each serving as a pixel and disposed in a matrix of M horizontal lines and N vertical lines, N being an integral value equal to or greater than 1 and M being an integral value greater than 1, and a switching element provided for each of said pixels and configured to provide a driving voltage to the pixel, comprising:

the M switching elements which are included in one vertical line having a common source line;

a step of controlling gate lines of $\alpha$ ones of the M switching elements included in one vertical line to be active simultaneously, $\alpha$ being an integral value greater than 1 but equal to or smaller than M.

4. The driving method for the liquid crystal panel according to claim 3, further comprising a step of controlling the source line common to the M pixels on one vertical line to be active simultaneously across $\beta$ ones of the vertical lines, $\beta$ being an integral value equal to or greater than 1 but equal to or smaller than N.

5. A non-transitory storage medium on which is recorded a program for causing a computer to control driving of a liquid crystal panel which includes a plurality of liquid crystal cells each serving as a pixel and disposed in a matrix of M horizontal lines and N vertical lines, N being an integral value equal to or greater than 1 and M being an integral value greater than 1, and a switching element provided for each of said pixels and configured to provide a driving voltage to the pixel, comprising:

a step of controlling, where the M switching elements which are included in one vertical line have a common source line, gate lines of $\alpha$ ones of the M switching elements included in one vertical line to be active simultaneously, $\alpha$ being an integral value greater than 1 but equal to or smaller than M.

6. The program according to claim 3, further comprising a step of controlling the source line common to the M pixels on one vertical line to be active simultaneously across $\beta$ ones of the vertical lines, $\beta$ being an integral value equal to or than 1 but equal to or smaller than N.

* * * * *